US009562336B2

(12) United States Patent
Adler et al.

(10) Patent No.: US 9,562,336 B2
(45) Date of Patent: Feb. 7, 2017

(54) REMOVABLE FLOODWALL SYSTEM, COMPONENTS AND METHOD OF INSTALLATION

(71) Applicant: RSA PROTECTIVE TECHNOLOGIES, LLC, Claremont, CA (US)

(72) Inventors: Richard S. Adler, Upland, CA (US); Roderic A. Ellman, Yonkers, NY (US)

(73) Assignee: RSA Protective Technologies, LLC, Claremont, CA (US)

( * ) Notice: Subject to any disclaimer, the term of this patent is extended or adjusted under 35 U.S.C. 154(b) by 0 days.

(21) Appl. No.: 14/098,036

(22) Filed: Dec. 5, 2013

(65) Prior Publication Data

US 2015/0147120 A1 May 28, 2015

Related U.S. Application Data

(60) Provisional application No. 61/909,821, filed on Nov. 27, 2013, provisional application No. 61/854,197, filed on Apr. 18, 2013, provisional application No. 61/849,029, filed on Jan. 16, 2013, provisional application No. 61/797,638, filed on Dec. 11, 2012.

(51) Int. Cl.
*E02B 3/10* (2006.01)

(52) U.S. Cl.
CPC ..... *E02B 3/108* (2013.01); *E02B 3/102* (2013.01)

(58) Field of Classification Search
USPC ..... 405/15, 16, 21, 107, 110, 111, 114, 115,405/116; 256/13
See application file for complete search history.

(56) References Cited

U.S. PATENT DOCUMENTS

| | | | | |
|---|---|---|---|---|
| 1,985,745 | A | 12/1934 | Roy | |
| 3,194,361 | A | 7/1965 | Thurman | |
| 4,259,028 | A * | 3/1981 | Cook | E02D 17/08 156/79 |
| 5,114,270 | A | 5/1992 | Riddle | |
| 5,697,736 | A * | 12/1997 | Veazey et al. | 405/284 |
| 5,993,113 | A | 11/1999 | Darling | |
| 6,042,301 | A | 3/2000 | Sovran | |
| 6,059,491 | A | 5/2000 | Striefel et al. | |
| 6,450,733 | B1 | 9/2002 | Krill et al. | |
| 8,313,265 | B2 * | 11/2012 | Taylor | 405/114 |
| 2007/0297856 | A1 | 12/2007 | Brachet | |
| 2009/0142136 | A1 * | 6/2009 | Thompson | 405/114 |

FOREIGN PATENT DOCUMENTS

| | | | |
|---|---|---|---|
| ES | 2349835 | A1 | 1/2011 |
| GB | 2389137 | A | 12/2003 |
| WO | WO-2011098152 | A1 | 8/2011 |

OTHER PUBLICATIONS

International Search Report mailed Apr. 29, 2014 in counterpart PCT Application PCT/US2013/073363.

(Continued)

*Primary Examiner* — Sean Andrish
(74) *Attorney, Agent, or Firm* — Stephen J. Lieb; Frommer Lawrence & Haug LLP

(57) ABSTRACT

A floodwall system comprises a plurality of wall panels detachably attached to a plurality of columns that are anchored to the ground. The plurality of wall panels include a plurality of chambers that receive water through perforations to increase the mass of these wall panels.

20 Claims, 38 Drawing Sheets

(56) References Cited

OTHER PUBLICATIONS

AquaFence, www.aquafence.com/us/projects; Accessed May 28, 2014.
Blobel, www.blobel.de/index.php, Accessed May 28, 2014.
Crane Materials International, CMI Sheet Piling and Piles Water Control, www.cmisheetpiling.com/applications/water-control/projectprofiles/the-wilds-asp, accessed May 28, 2014.
Eko Flood USA, Complete Flood Protection Solutions, ekofloodusa.com/closures.php, Accessed May 28, 2014.
Flood Control America brochure, www.floodcontrolam.com, Accessed May 28, 2014.
Gesellschaft für operativen Hochwasserschutz (GOH), Mobile Flood protection DPS 2000; www.goh.de/operativer_hochwasserschutz_goh.php; Accessed May 28, 2014.
IBS Engineered Products, Ltd., IBS Flow Control Equipment, www.ibsengineeredproducts.co.uk/en/Flow-Control-Systems/General.php, Accessed May 28, 2014.

* cited by examiner

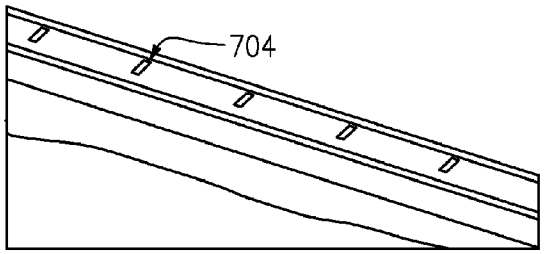
FIG. 7(a)
FIG. 7(b)
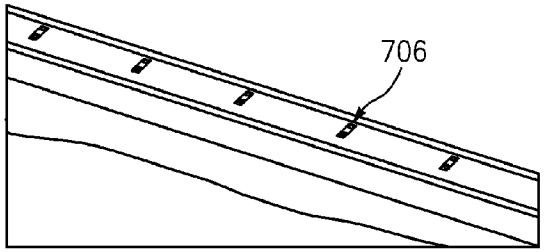
FIG. 7(c)
FIG. 7(d)
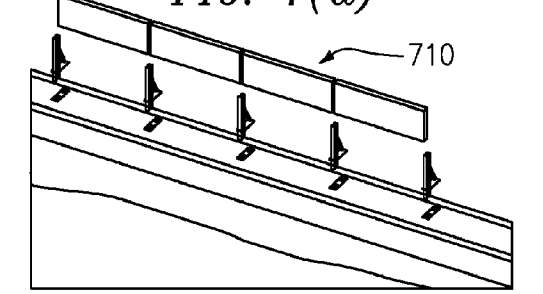
FIG. 7(e)
FIG. 7(f)

REMOVABLE FLOODWALL SYSTEM, COMPONENTS AND METHOD OF INSTALLATION

RELATED APPLICATION

This application claims benefit to Provisional Application Ser. No. 61/909,821, filed on Nov. 27, 2013, and Provisional Application Ser. No. 61/854,197, filed on Apr. 18, 2013, and Provisional Application Ser. No. 61/849,029, filed on Jan. 16, 2013, and Provisional Application No. 61/797,638, filed on Dec. 11, 2012, the disclosures of all of which are incorporated herein by reference.

BACKGROUND

1. Field of the Invention

This invention relates generally to a floodwall system that provides protection against coastal flooding or storm surge and the installation method thereof.

2. Background Discussion

Coastal cities such as New York City have experience unprecedented damages caused by storm surge and flood water due to extreme weather conditions such as hurricane, super storms, and rising of sea levels. When super storm Sandy hit New York City, it forced a record 13-foot storm surge that overflowed the city's historic waterfront, flooded the financial district and subway tunnels and cut power to nearly a million people. New York City had to shut down its mass transit system, schools, the stock exchange, tunnels, and Broadway. Thousands of new New Yorkers who lived close to the shore were ordered to evacuate from their homes, most of which were inundated by the storm surge.

Damage from flood water has been experienced by human beings for thousands of years. Permanent civil structures including walls, barriers, and levees have been traditionally used to provide protections against storm surge. However, they have several drawbacks in view of current development practices and weather threats. More communities have been developed along coastal areas and river fronts because of the attractiveness of the scenery view and lifestyle. Erecting permanent structures to stop flood water is not favored by local communities because those structures are not aesthetically appealing.

SUMMARY

To overcome the issues associated with traditional permanent flood barriers, this application presents a removable and fast-deployable floodwall system which is capable of being installed in advance of an anticipated storm, e.g., within days or a day, at locations where needed. The floodwall system can be removed after the storm without a prolonged intrusion of the landscape of a coastal area. The floodwall system includes pre-manufactured modular panels that can be attached to each other to form an extended protection wall and/or stacked to raise the height of the system.

An aspect of the present application is directed to a floodwall system. The floodwall system comprises a plurality of wall panels detachably attached to a plurality of columns that are anchored to the ground. According to some embodiments, the plurality of wall panels include a plurality of chambers that receive water through perforations to increase the mass of these wall panels.

According to some embodiments, the floodwall system comprises a foundation system that is anchored to the ground. According to some embodiments, the height of the foundation system is adjustable. According to some embodiments, the foundation system is secured to the ground by at least a rock anchor. According to some embodiments, the foundation system may include a shallow mount bollard system, and/or a plate member to prevent piping, and/or a shoe member fixed on a rebar cage.

According to some embodiments, the sizes of the perforations of the wall panel may be gradually enlarged from the bottom of the wall panel to the top of the wall panel. According to some embodiments, the wall panel may include water seals at two ends, and/or a plurality of handles used for lifting purposes during deployment, and/or a sleeve member that fits a bollard, and/or a sloped bottom, and/or two offset portions.

According to some embodiments, the column may include a knee brace attached to an upper leg of the column and a ground support member of the column. The ground support member, upon installation, is located substantially at a ground level. According to some embodiments, the column may include a panel lock. According to some embodiments, the columns include at least one angled column that allows adjacent wall panels to form an angle with each other.

According to some embodiments, the wall panels are dropped down to positions in between columns. According to some embodiments, the floodwall system may comprise a gate, and/or attachment members that attach columns to adjacent existing structures, and/or a boat launch.

BRIEF DESCRIPTION OF DRAWINGS

To the accomplishment of the foregoing and related ends, certain illustrative embodiments of the invention are described herein in connection with the following description and the annexed drawings. These embodiments are indicative, however, of but a few of the various ways in which the principles of the invention may be employed and the present invention is intended to include all such aspects and their equivalents. Other advantages, embodiments and novel features of the invention may become apparent from the following description of the invention when considered in conjunction with the drawings. The following description, given by way of example, but not intended to limit the invention solely to the specific embodiments described, may best be understood in conjunction with the accompanying drawings, in which:

FIGS. 7(*a*)-(*f*) illustrates various embodiments of foundation systems.

DETAILED DESCRIPTION

Embodiments of the floodwall system, components, and installation method are disclosed or are apparent from and encompassed by, the following description.

Overview of the Removable Floodwall System

Figure 1:
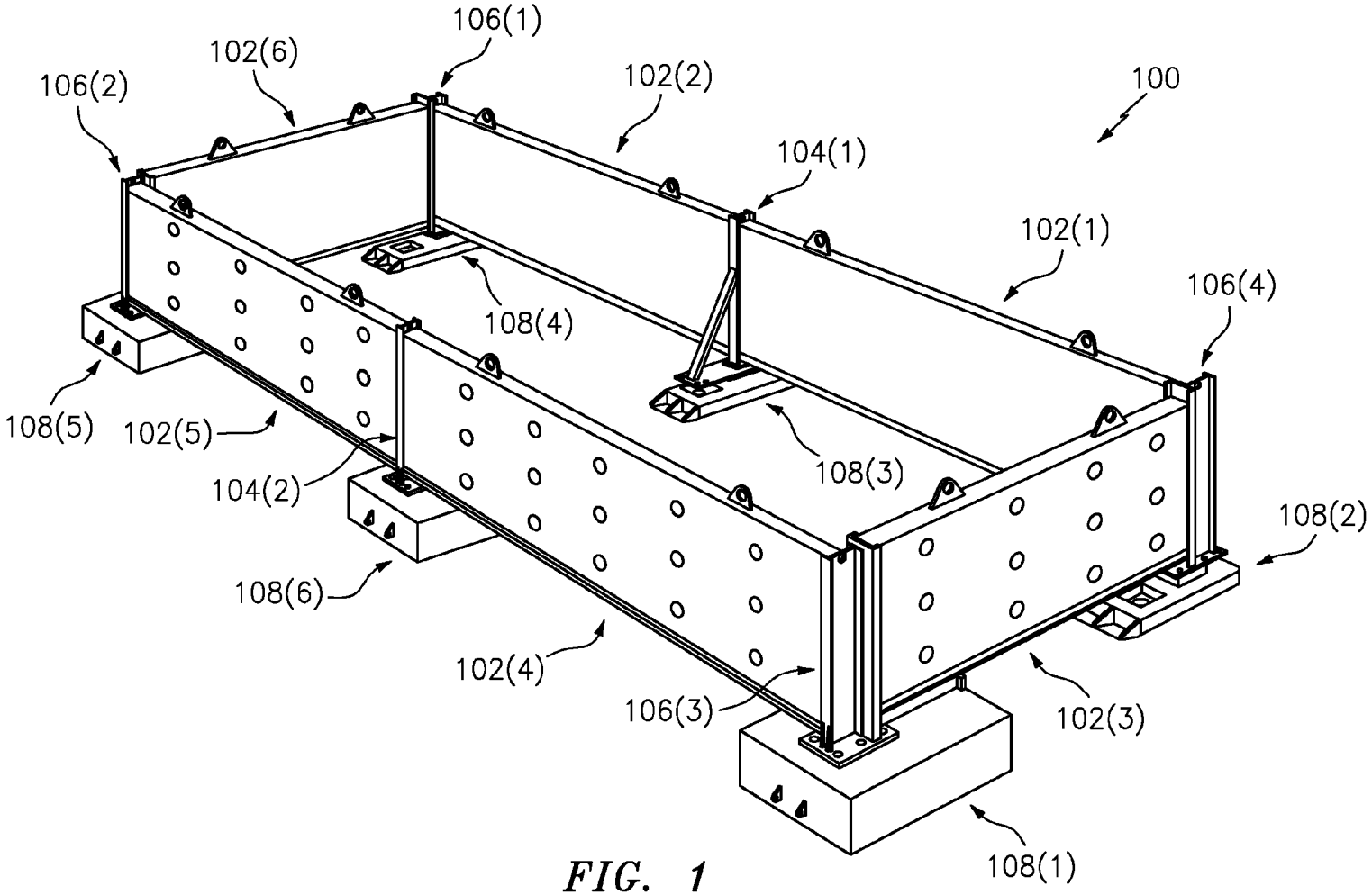
FIG. 1 illustrates an embodiment of a floodwall system.

FIG. 1 illustrates an embodiment of a removable floodwall system 100 which forms an enclosure with wall panels 102(1)-(6) connected by panel columns including straight columns 104(1) and 104(2) and angled columns 106(1)-(4). Water seals are placed at the contact areas between wall panels and columns or between wall panels and the ground to prevent water from leaking through the floodwall system 100. Suitable materials are used to construct the wall panels and the columns of adequate mechanical integrity to resist the forces produced by the flood water, wind, waves, or collision by vehicles or ships. Preferred materials include stainless steel, concrete, wood, composite material, and polymeric materials.

The columns 104 are secured on a foundation system that is anchored to the ground or bedrock underneath the ground. The foundation system is formed by a plurality of individual foundations 108(1)-(6) which may support the columns independently or may be connected with each other to integrally support the columns 104. The foundations 108(1)-(6) may be formed by a concrete block, a stainless steel plate secured to the ground, a bollard, or any other structure that substantially limits the movement of the columns either by its mass or its attachment to another structure or ground. Both the columns and the wall panels are detachable from the foundations or the columns, thus making the floodwall system a removable structure.

Figure 2A:
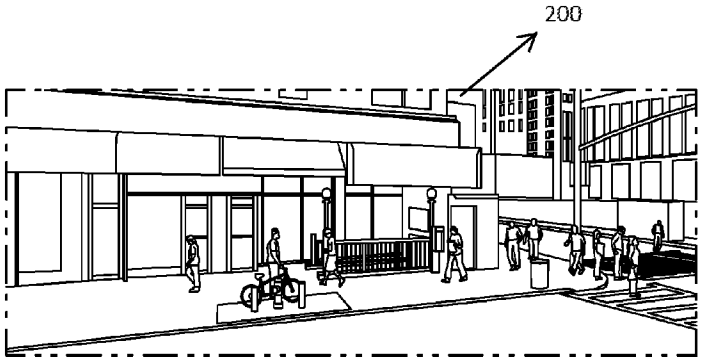
FIGS. 2(*a*)-(*c*) illustrate various embodiments of a floodwall system protecting a subway entrance.
Figure 2C:
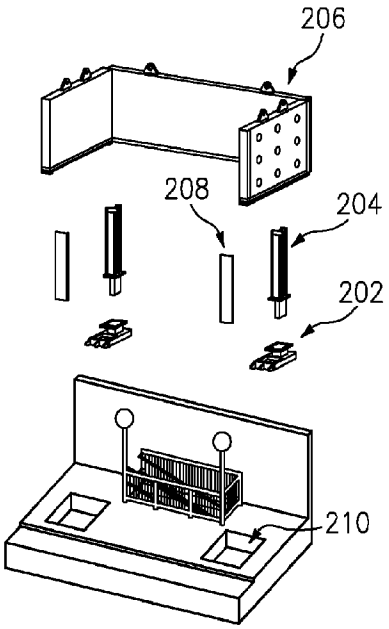
Figure 2B:
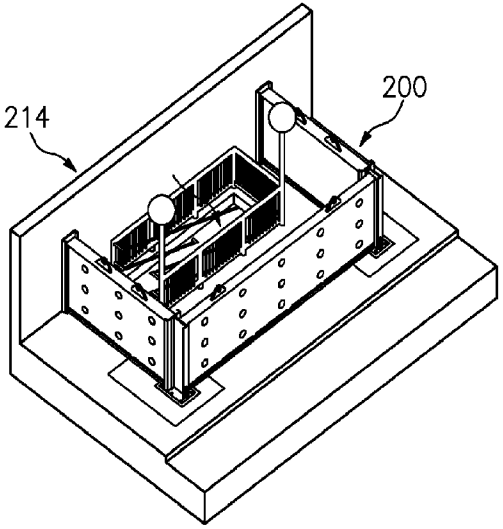

FIGS. 2(*a*)-2(*c*) illustrate an application of a removable floodwall system 200. As shown in FIG. 2(*a*), a subway entrance is located at the grade level in an urban street. Without any protective measure, flood water enters the subway entrance, which threatens the operation and safety of trains. The floodwall system 200 as shown in FIG. 2(*b*) can be deployed just before, e.g., a few hours or a day or two before, the storm to enclose the subway entrance. The foundation of the floodwall system 200 can be built into the sidewalk. In this example, a wall 214 of an adjacent building is used together with three wall panels to encircle the subway entrance. The two side wall panels are attached to the building walls with bolts or bonding materials. A water seal 208 is placed between the building walls and the two side wall panels to have a water tight connection. In another embodiment, four or more panels are used to set up an independent floodwall system that does not require any attachment to an existing structure. In certain embodiments, excavation 210 in the ground may not be needed. The wall panels may be secured to existing structures such as bollards or may be secured directed to the ground by ground anchors.

FIG. 2(*c*) illustrates an embodiment of a few components included in the floodwall system 200 shown in FIG. 2(*b*). The floodwall system 200 includes wall panels 206, columns 204, foundations 202, and water seals 208. The foundations 202 are placed in the excavations 210 on the sidewalk. The water seals are used between the panels 206 and the building wall or between the wall panels 206 and the columns 204.

The Foundation System of the Floodwall System

Figure 3:
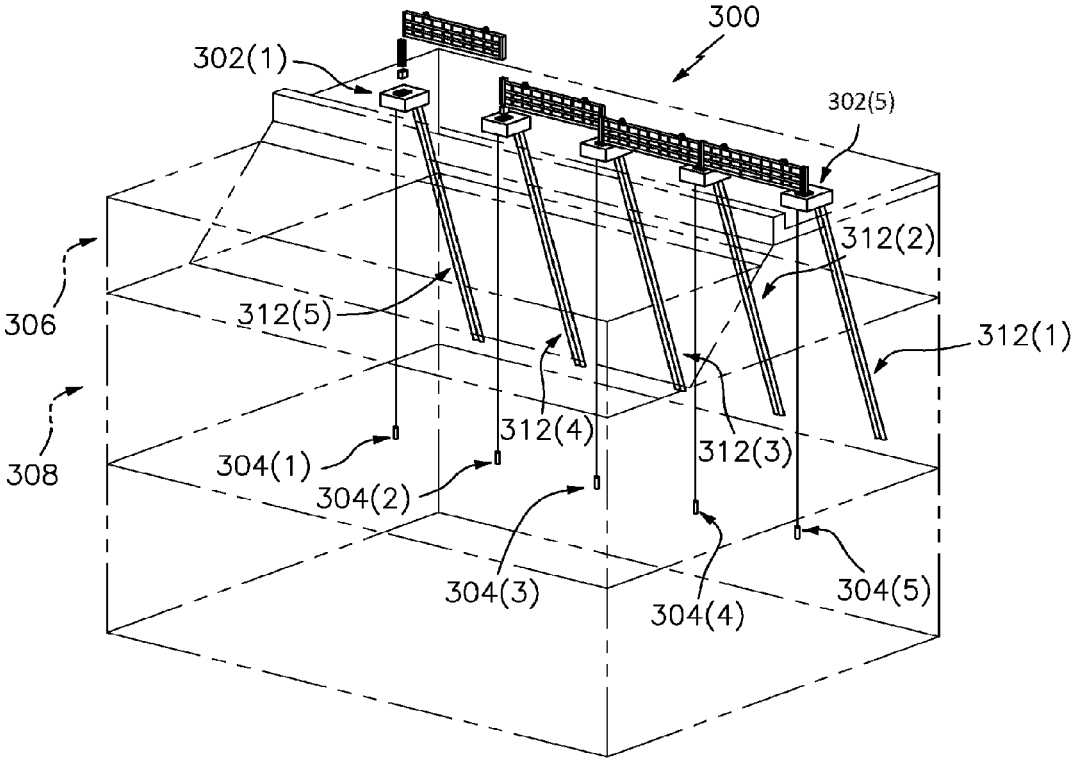
FIG. 3 illustrates an embodiment of a foundation system of a floodwall system.

FIG. 3 illustrates an embodiment of a foundation system of the floodwall system. The foundation system 300 includes a plurality of individual foundations 302(1)-302(5). As shown in FIG. 3, each column may have its own foundation. The plurality of foundations 302(1)-302(5) may be independent from each other, i.e. every foundation is separately secured to the ground without the assistance from another one. The plurality of the foundation systems 302(1)-302(5) may also be integrated with each other by using attachment means such as concrete connectors or steel pipes. According to one embodiment, these foundations may be formed by a shallow mount bollard system as disclosed in U.S. Pat. No. 8,215,865, the disclosure of which is herein incorporated by reference. The foundation system 300 is preferably located at the grade level to avoid disruptions of the landscape.

According to one embodiment, the foundations 302(1)-302(5) are secured to the ground 306 or to the bedrock 308 underneath the ground 306 by anchors. An anchor is a structural element installed in soil or rock that is used to transmit an applied tensile or compressive load into the ground. There are many types of anchors that are being used to temporarily or permanently secure a structure to the ground, including mechanical anchors, grouted ground anchors, and bonded anchors. The following patents have described several examples of anchors, such as U.S. Pat. Nos. 5,625,984, 6,983,568, 8,220,209, and 7,603,818, the disclosures of all of which are incorporated herein by reference.

As shown in FIG. 3, an embodiment of the foundation system 300 uses rock/tension anchors 304(1)-304(5) and dual mini piles 312(1)-312(5) to secure the foundations

302(1)-302(5). The dual mini piles 312(1)-312(5) form an angle with the rock/tension anchors 304(1)-304(5) and extend in a direction away from the sea. The rock/tension anchors 304(1)-304(5) are place between the sea and the dual mini piles 312(1)-312(5) and extend substantially vertically into the ground. According to another embodiment, the foundation system 300 is made of concrete or made of hollow members filed with concrete or water, thus using its own mass or weight to secure themselves to the ground 306.

Figure 4B:
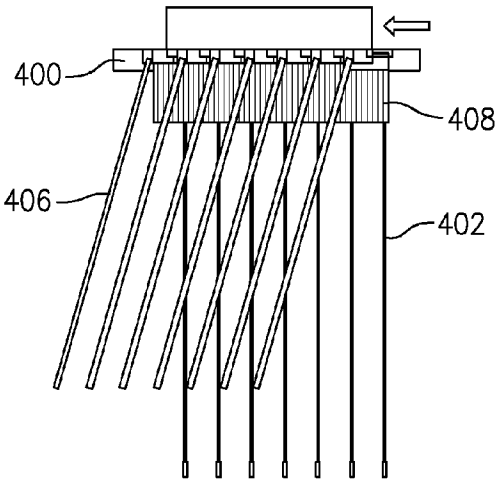
FIGS. 4(*a*)-(*c*) illustrates various embodiments of foundation systems.
Figure 4A:
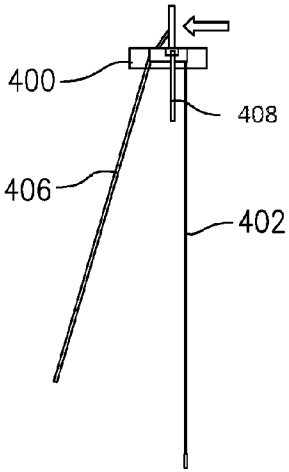
Figure 4C:
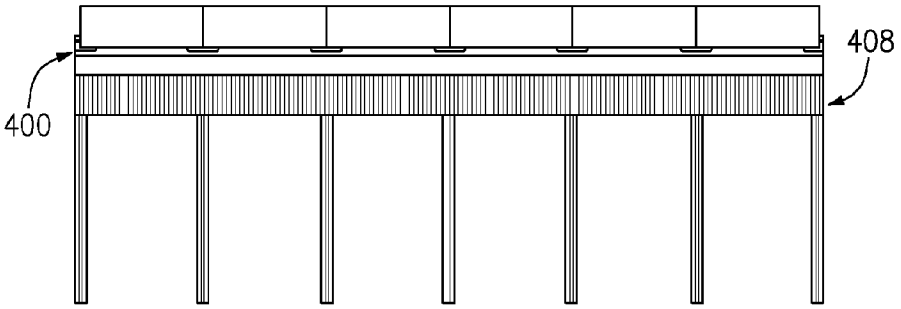

FIGS. 4 (*a*)-(*c*) illustrate another embodiment of a foundation system 400. The foundation system 400 includes not only rock/tension anchors 402 and dual mini piles 406, but also includes a plate member 408 as a barrier to prevent piping. When soil is soaked in water for a prolonged period, water may seep through soil from underground. The seepage of water causes erosion of the soil. In severe situations, the erosion of the soil can form a channel underneath the ground that allows water to pass through. The barrier plate is placed underneath the foundation system 400 to increase the seepage path of the flood water. The barrier plate member 408 can reduce the seepage pressure of water and reduce the chances of piping. The barrier plate member 408 can be made of any materials that are water resistant including stainless steel, concrete, plastic, and wood.

Figure 5B:
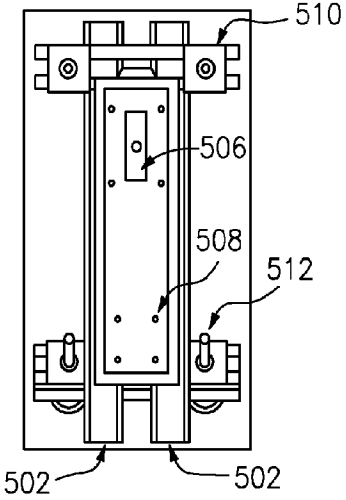
FIGS. 5(*a*)-(*c*) illustrates various embodiments of foundation systems.
Figure 5C:
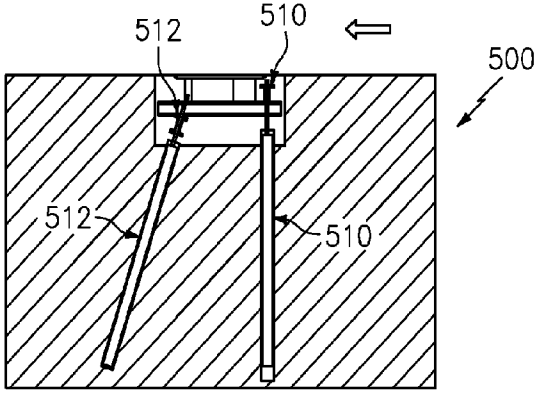
Figure 5A:
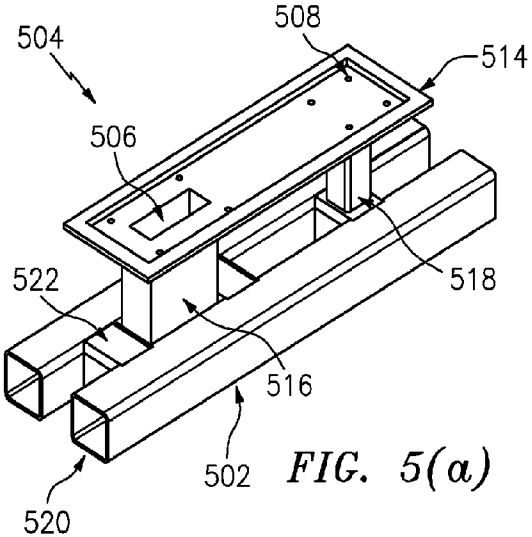
Figure 6B:
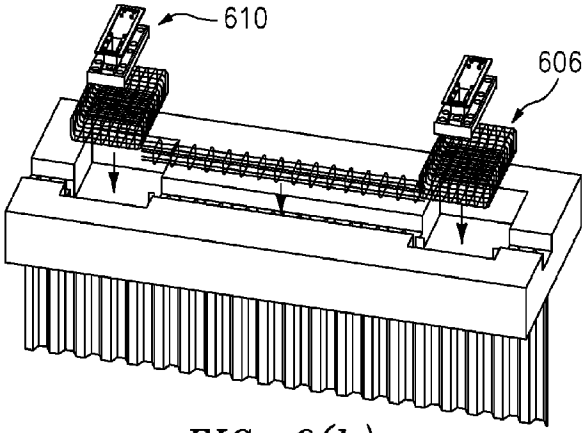
FIGS. 6(*a*)-(*d*) illustrates various embodiments of foundation systems.
Figure 6D:
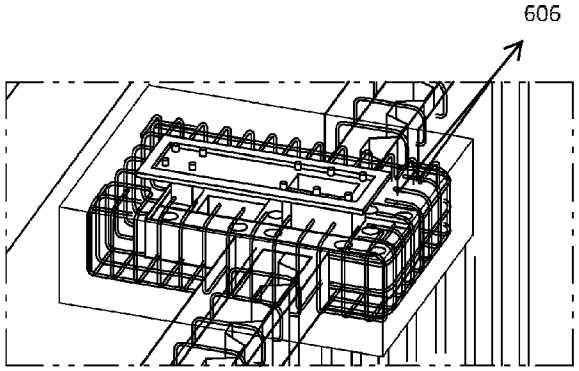
Figure 6A:
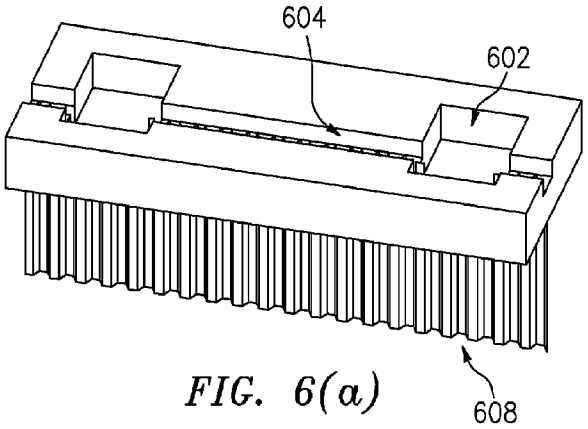
Figure 6C:
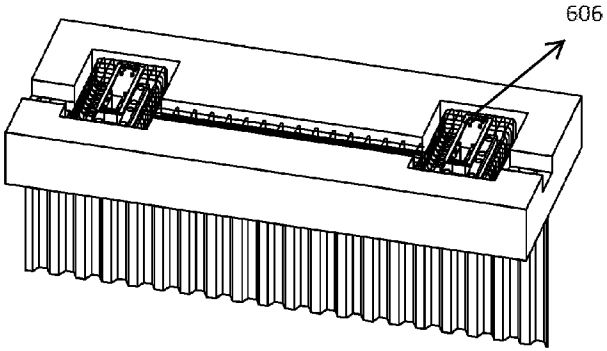

FIG. 5(*a*)-(*c*) illustrate an embodiment of a shoe member 514 of the foundation system 500. The shoe member 514 includes an opening 506 to accommodate columns, a column attachment plate 504 to secure the support column through a plurality of attachment means such as screws, bolts, glues, bonders, latches, or welds. The shoe member 514 also includes a base 502 used to attach the anchors, such as the dual mini piles 512 and the rock/tension anchor 510, and to secure the shoe member 514 inside the foundation. According to one embodiment, the base 502 are formed by two longitudinal parallel tubular members 520 joined by a plurality of short tubular members 522 whose directions are substantially perpendicular to the longitudinal tubular members 520. The column fixture 508 and the base 502 are attached to each other by a plurality of tubular legs 516 and 518. According to one embodiment, the tubular leg 516 encloses the opening 506. According to one embodiment, the height of the shoe member 514 is adjustable so that all the shoe members 514 of the floodwall system are at the same height level. After the shoe member 514 is attached to the anchors, the available space in the excavation may be left as it is or may be filled with mass materials such as sand, soil, stone, or concrete.

FIGS. 6(*a*)-(*d*) illustrate an embodiment of an installation method of a foundation system. The foundation system installation starts by preparing the ground by excavating soils. The excavations include a first excavation 602 to accept the individual foundations. The excavations may further include a second excavation 604 that is used to tie the first excavations 602. A barrier plate 608 is subsequently placed along the excavation's edges that face the sea or water. The barrier plate 608 is pushed to certain depth of the soil based on the soil conditions and forms a continuous barrier to prevent piping. As shown in FIG. 6(*b*), rebar boxes or cages 606 are placed in the excavations and then the shoe members 610 are placed in the rebar cages and attached with the anchors. After the shoe members 610 are fixed, their heights are adjusted to be at the same level. The rebar cages 606 may be further filled with concrete to secure the shoe members 610 to individual foundation.

FIGS. 7(*a*)-(*f*) illustrate an embodiment of components which disguise and protect a foundation system. When wall panels and columns of a floodwall system are removed from the foundation system, the foundation system may be protected from human or natural damages and be concealed or covered or decorated to preserve the attractiveness of the coastal scene or river front view. FIG. 7(*a*) shows that a cover plate 702 is placed on top of the foundation system 700 to provide an even and uniform look with the surrounding environment. When the cover plate 702 is removed, as shown in FIG. 7(*b*), the shoe members 704 securing the columns are accessible to workers. The shoe members 704 may have another cover 705 to prevent objects from falling into the opening 706 that is used to attach the leg of the columns. After the covers 705 are removed, the columns 708 can be inserted into the openings and be secured to the foundation system 700. Then, the wall panels 710 are lowered between the columns to form the floodwall system.

Wall Panels

Figure 8:
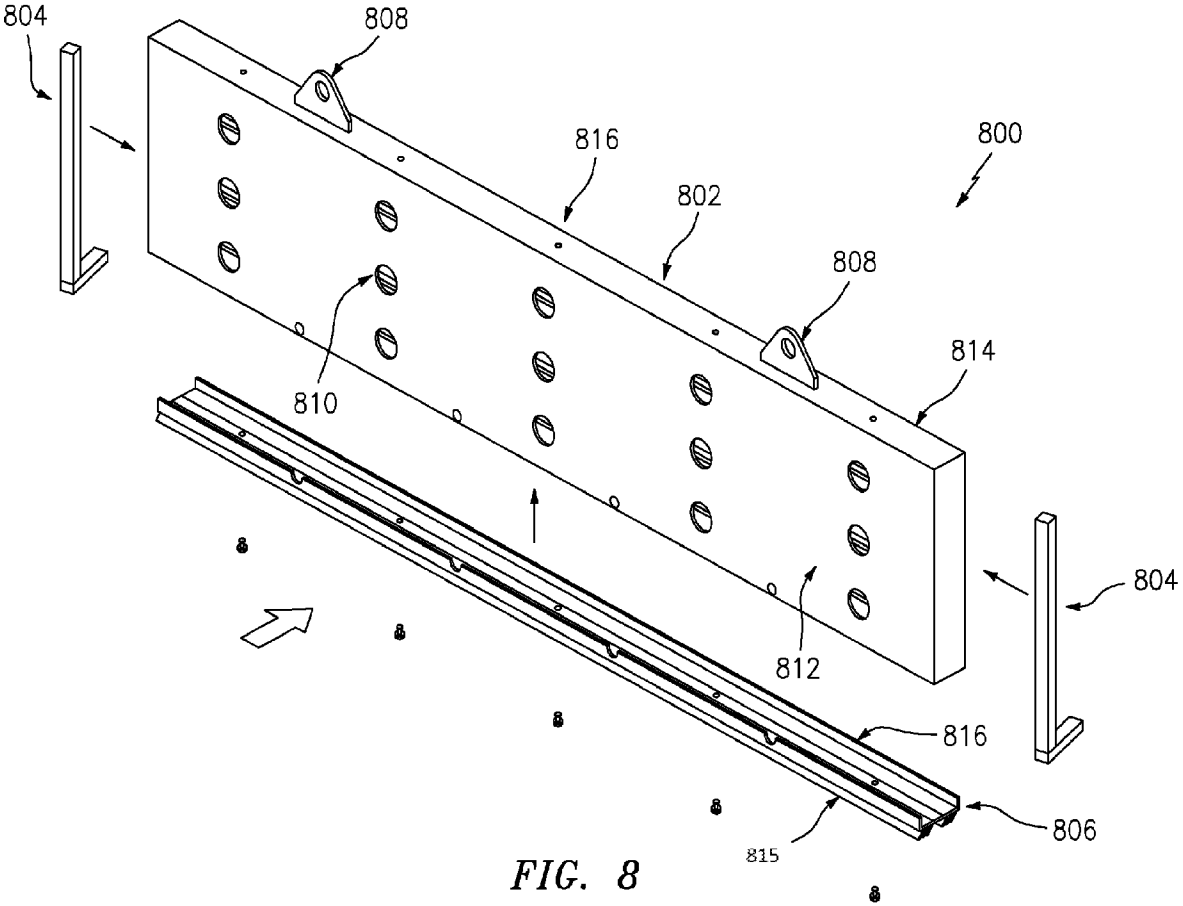
FIG. 8 illustrates an embodiment of a wall panel.
Figure 9B:
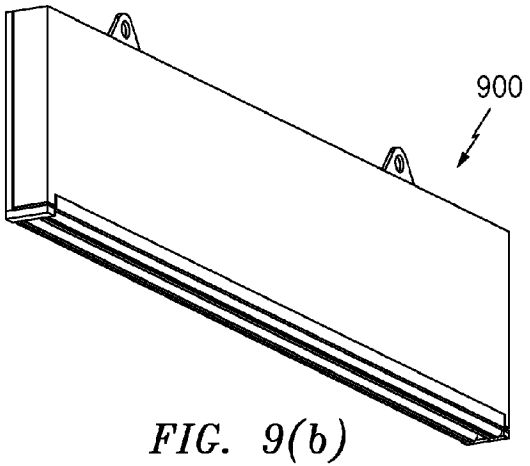
FIGS. 9(*a*)-(*d*) illustrate various embodiments of wall panels.
Figure 9D:
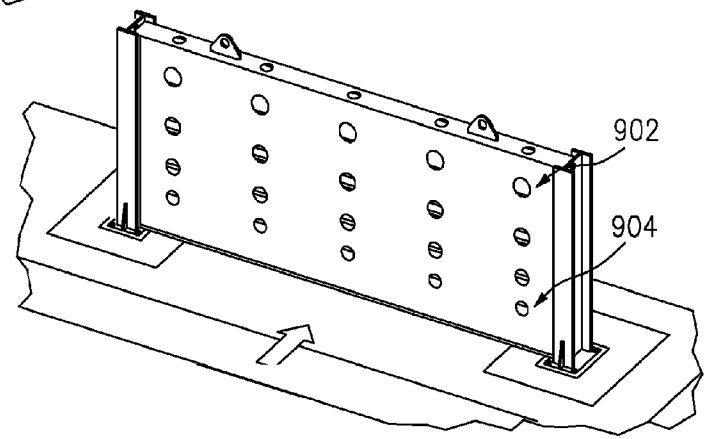
Figure 9A:
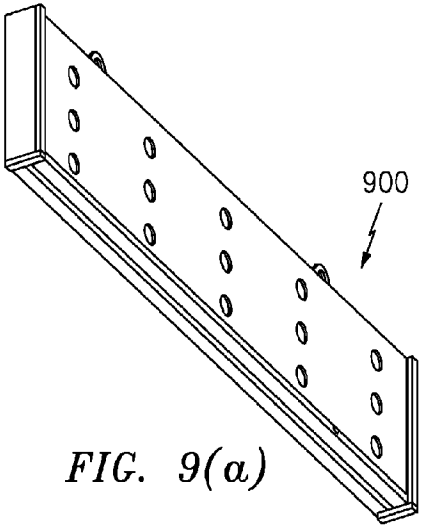
Figure 9C:
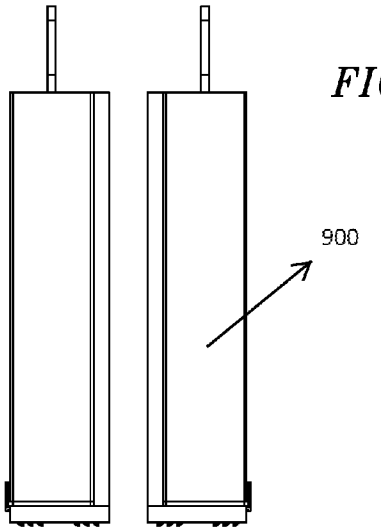

FIG. 8 illustrates an embodiment of the construction of a wall panel. The wall panel 800 includes a hollow chamber 802, side water seals 804, a bottom water seal 806, and ear handles 808. The wall panels 800 are preferably pre-manufactured according to standard sizes such as 20 feet long and 4, 6, or 8 feet tall.

The wall panel 800 is made of material having adequate strength to resist pressures by water or any other possible impact to the floodwall such as floating debris or other impacts by ships or vehicles. Structural engineering materials such as stainless steel, concrete, polymers, wood, stones, and similar materials can be used to make the wall panel 800. The hollow chamber 802 may be made by several plates with internal reinforcement members. Providing a hollow chamber 802 reduces weight during storage, shipment, and installation. The hollow chamber 802 further includes plural ear handles 808 that are used to move the wall panel during installation or shipment. The hollow chamber 802 has a wet side 812 that faces the water and a dry side 814 that faces away from the water.

The wet side 812 has a plurality of perforations 810 that allow water to enter the body of the wall portion when the flood water is pushing the wall panel. Once the water entered the wall portion, they increase the mass of the floodwall system and reduce the movement of the floodwall system. Thus, the flood water itself is used by the floodwall system to stop the flood. The perforations at the wet side of the chamber 802 may have the same size or may have a gradually enlarged size that increases from the bottom of the panel to the top of the panel. The hollow chamber 802 may also include plural perforations at the top plate to allow air to get out of the chamber when water enters. The perforations in the top plate of the wall panel 800 also reduce any upward force generated by the waves of the water.

The side water seal 804 helps to create a water tight contact between the wall panel 800 and the columns. The bottom water seal 806 prevents water from leaking though the gaps between the wall panel 800 and the ground. The bottom water seal 806 is formed by attaching seals 815 to a plate 816, which is subsequently attached to the wall portion. The seals 815 include both a wet side seal portion and a dry side seal portion. The water seals may be any material that prevents water from leaking through. Preferable materials include rubber, glue, caulk, silicon, tapes, or similar materials.

FIG. 9(*a*) illustrates a wall panel 900 viewed from the wet side.

FIG. 9(*b*) illustrates a wall panel 900 viewed from the dry side.

FIG. 9(*c*) illustrates a wall panel 900 viewed from the side.

FIG. 9(*d*) illustrates an embodiment of the wall panel 900 installed between columns. The perforations of the wall panel 900 increase their diameters depending on the height of the wall panel. As shown in FIG. 9(*d*), the perforation 904 at the bottom of the wall panel has a smaller size than the perforation 902 at the top of the wall panel.

Columns

Figure 10B:
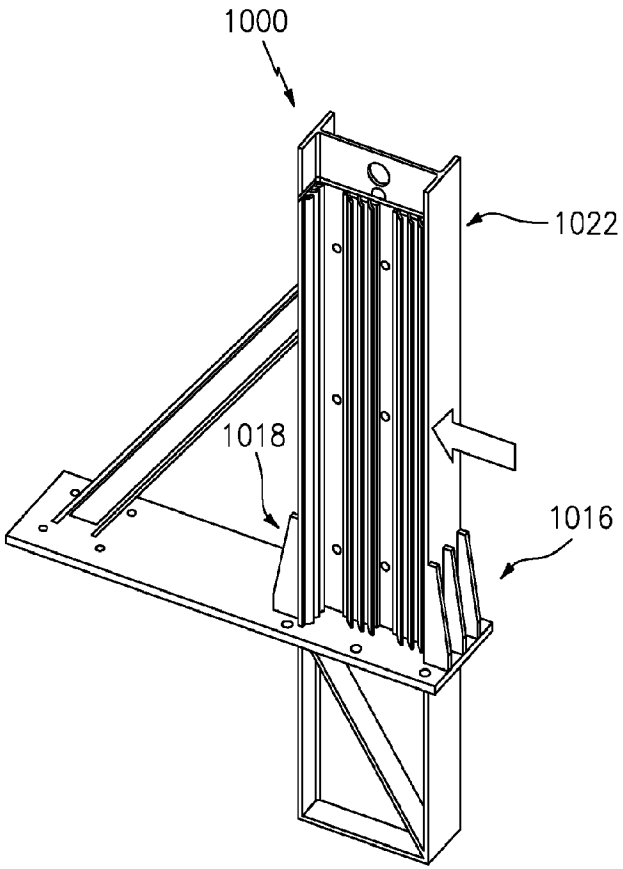
FIGS. 10(*a*) and (*b*) illustrate an embodiment of a column.
Figure 10A:
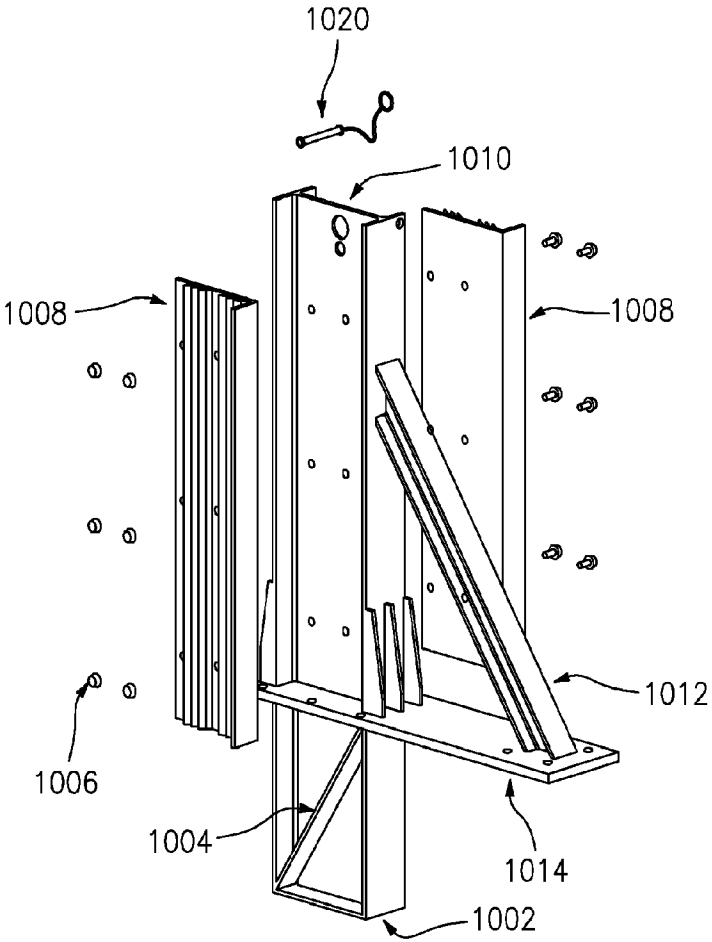

FIGS. 10(*a*) and 10(*b*) illustrate a straight column. The straight column 1000 connects two wall panels and allows a straight wall section to be formed. The straight column 1000 includes a lower column leg 1002, an upper column leg 1022, a leg reinforce member 1004, a plurality of seal securing means 1006, seal members 1008, a plurality of openings 1010, a ground support member 1014, a brace member 1012, a plurality of wet side corner reinforce members 1016, a plurality of dry side corner reinforce member 1018, and a panel lock member 1020. Except for the water seal, all the members of the panel column 1000 are preferably made of stainless steel. Other materials are also acceptable as long as they can provide adequate structure support even submerged in water.

The upper column leg 1022 has a generally I-shaped cross-section, which has two U-shape grooves formed by the two flanges of the upper column leg 1022. Upon installation, wall panels will be dropped down into the groove of the upper column leg 1022.

The ground support member 1014 is placed at the level of the ground after the column is installed on the foundation. The lower column leg 1002 and the upper column leg 1022 are attached to the ground support member 1014. The brace member 1012 is attached to both the upper column leg 1022 and the ground support member 1014 to reinforce the upper column leg 1022. The corner reinforce members 1016 and 1018 are also placed and attached to the corners formed between the ground support member 1014 and the upper column leg 1022. The leg reinforce member 1004 is placed inside the lower column leg along a diagonal direction. The brace member 1012 may be an I-shape steel beam or may be an angle iron.

The seal members 1008 are attached to the upper column leg 1022 by a plurality of fixing means such as screws, bolts, glue, and similar techniques. The seal members 1008 are detachable so that they can be replaced. The seal members 1008 include water seals secured to a plate member, whose detailed construction will be described in connection with FIG. 11. The upper column leg 1022 also has an opening 1010 to be used with a panel lock member 1020 to secure the wall panel. After the panel lock member 1020 is placed in the opening 1010, vertical movement of the wall panel will be substantially restricted.

Figure 11B:
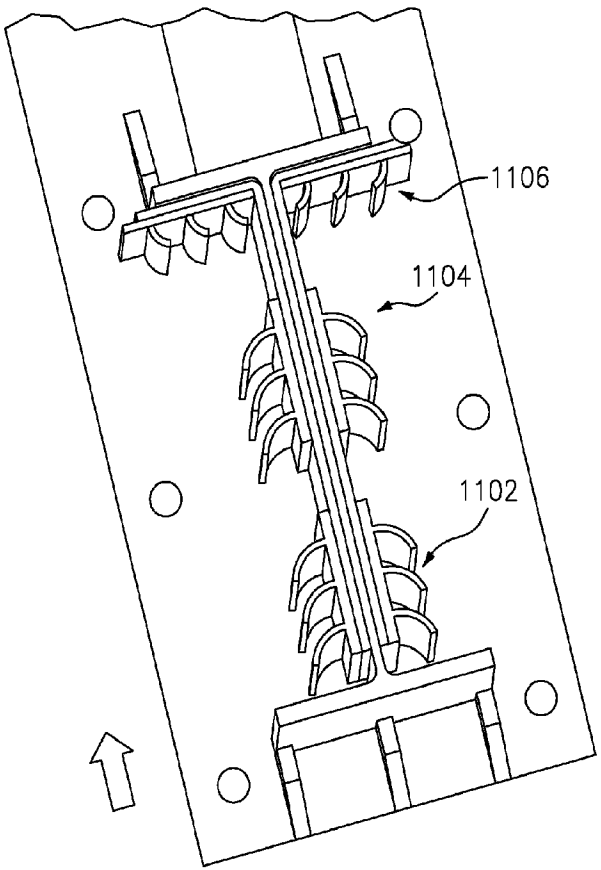
FIGS. 11(*a*) and (*b*) illustrate various embodiments of columns.
Figure 11A:
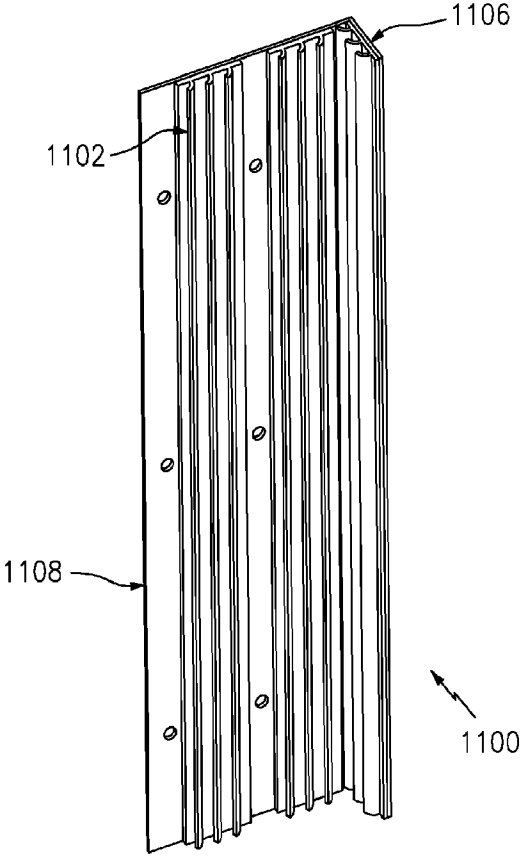

FIG. 11(*a*)-(*b*) illustrates an embodiment of the water seal construction of the seal member. The seal member 1100 has a generally L shaped cross-section. The seal member 1100 has a plurality of finger seals 1102, 1104, and 1106. The plurality of finger seals are parallel with each other and placed on the seal member along its longitudinal direction. Each finger seal 1102, 1104, or 1106 includes a plurality of flexible finger-shaped sheets on a flat base. The flexible finger-shape sheets, when pressed by the wall panel, are squeezed to fill in any gap in the contact area, thus preventing water from passing through. The water seal 1106 is placed at the dry side of column. In this way, when water is pushing the wall panel from the wet side, the wall panel will be forced into a tight contact with the dry side seal 1106 and form a water tight seal. The seals 1102, 1104, and 1106 are attached to a plate 1108 by any suitable fixing means including glue and bonding. According to an embodiment, the water seal 1102, 1104, and 1106 and the plate 1108 may be an integral single piece formed by the same polymeric material or rubber material through molding or intruding processes.

Figure 12A:
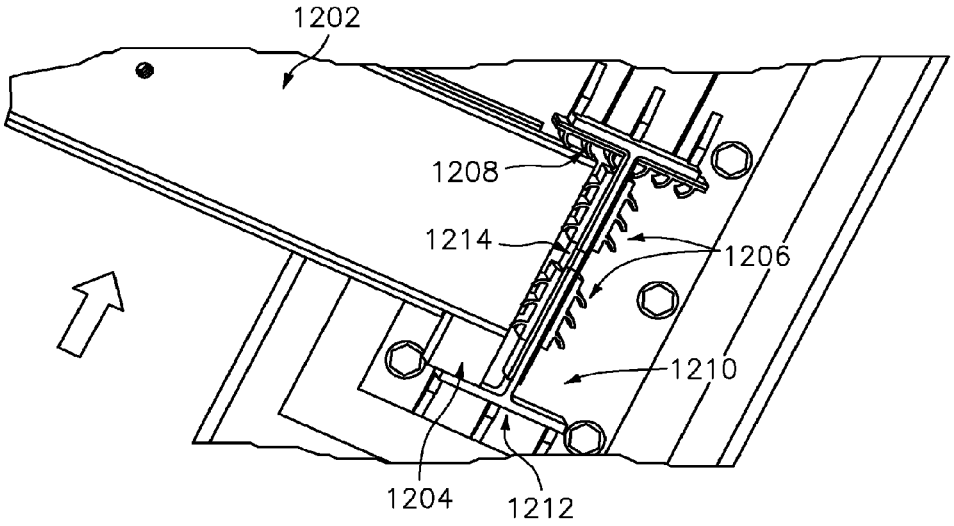
FIGS. 12(*a*) and (*b*) illustrate an embodiment of the water tight contact between wall panels and columns.
Figure 12B:
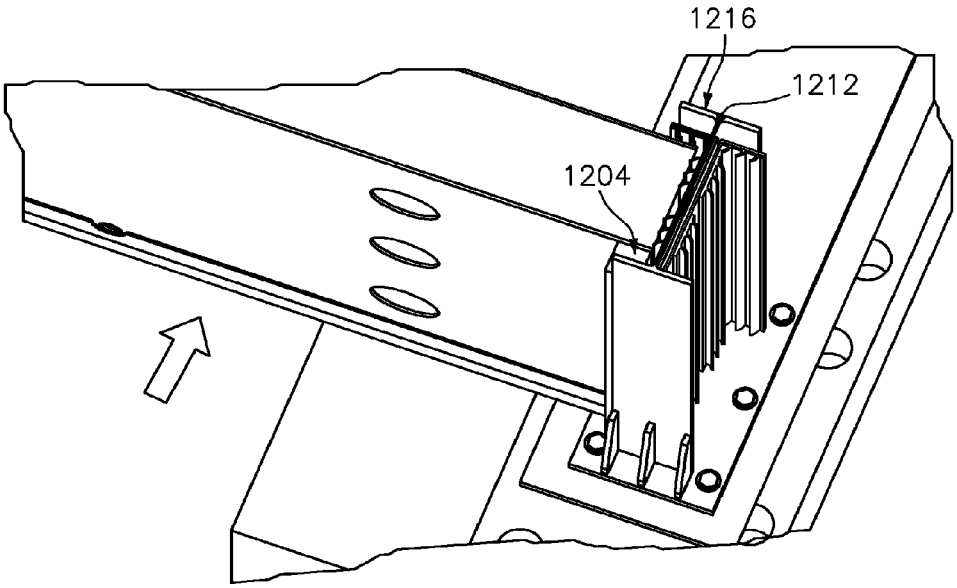

FIGS. 12(*a*) and 12(*b*) illustrate an embodiment of the connection between a wall panel and a column. The wall panel 1202 is lowered into the U-shaped track 1210 formed by the flanges 1216 and the center portion 1214 of the column 1212. When the wall panel 1202 is in contact with the column 1212, the wall panel 1202 pushes the water seals 1208 and 1206 to form a water tight contact. As the flood water pushes the wall panel toward the dry side, a gap may be formed between the wet side of the wall panel 1202 and the column. According to an embodiment, another water seal strip 1204 is placed between the wet side of the wall panel 1202 and the flanges 1216 of the column 1212 to prevent water leakage. According to an embodiment, the water seal strip 1204 may be formed by spraying a quick cure elastomer after the floodwall system is installed.

Panel Locks

Figure 13B:
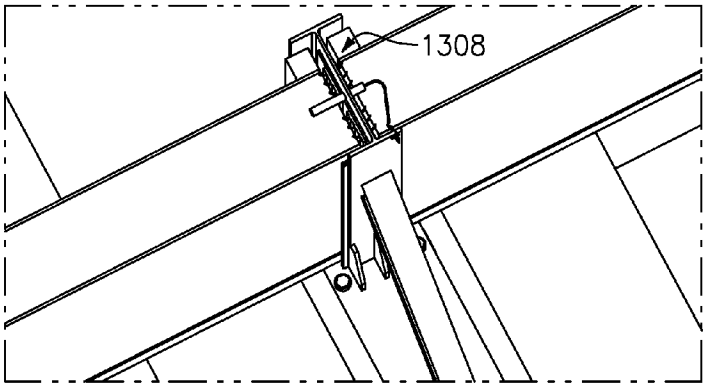
FIGS. 13(*a*)-(*c*) illustrate various embodiments of a panel clock.
Figure 13A:
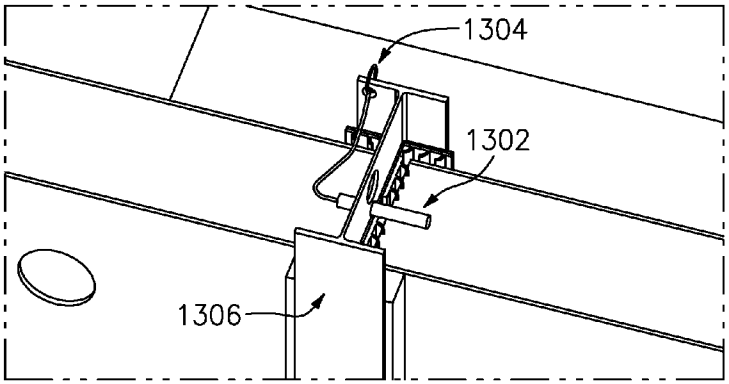
Figure 13C:
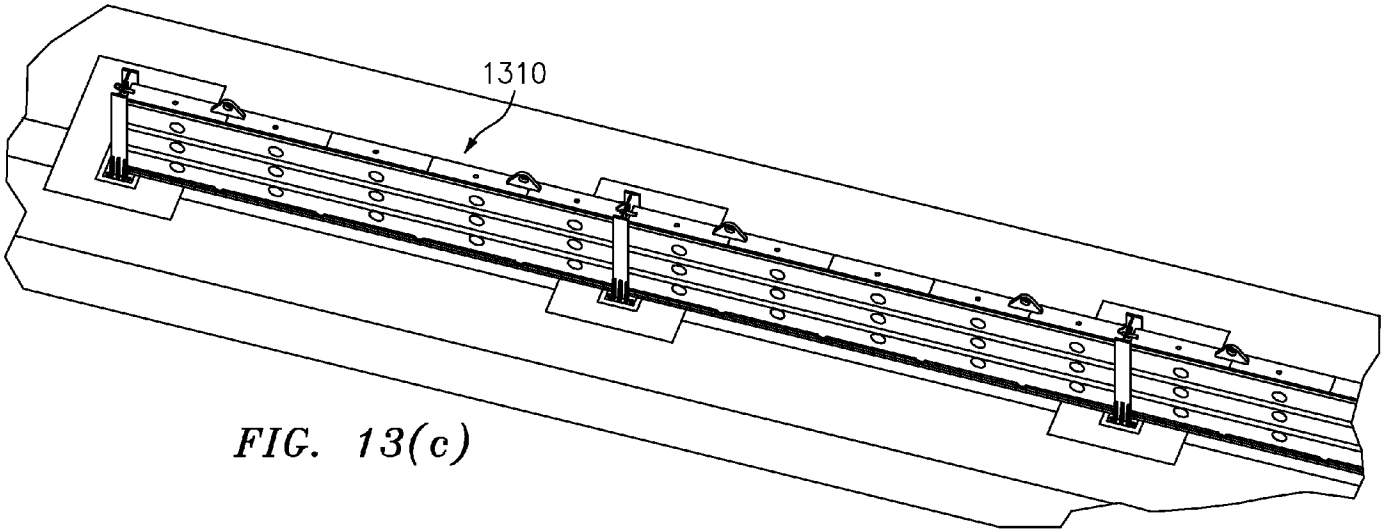

FIGS. 13(*a*)-(*c*) illustrate an embodiment of panel locks to restrict the movement of the wall panels. The panel lock 1302 may be a steel bar or steel pipe that can be placed into the opening at the top of the center portion 1308 of the column 1306. The panel lock 1302 has extensions overlapping with wall panels at both sides of the column 1306. The panel locks 1302 further include attachment means for securing the panel locks 1302 to the column 1306. When the flood water is pounding wall panels 1310, the wall panels may move back and forth or even move up and down, which can cause water leakage and damage the wall panels. The panel lock 1302 restricts the movement of the wall panels 1310, thus protecting the whole system from being damaged or leaking water.

Gate

Figure 14C:
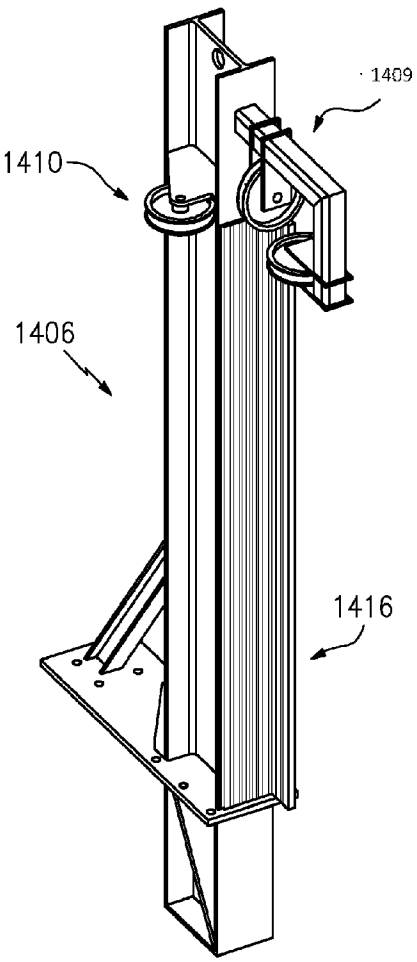
FIGS. 14(*a*)-(*c*) illustrate various embodiments of a gate.
Figure 14B:
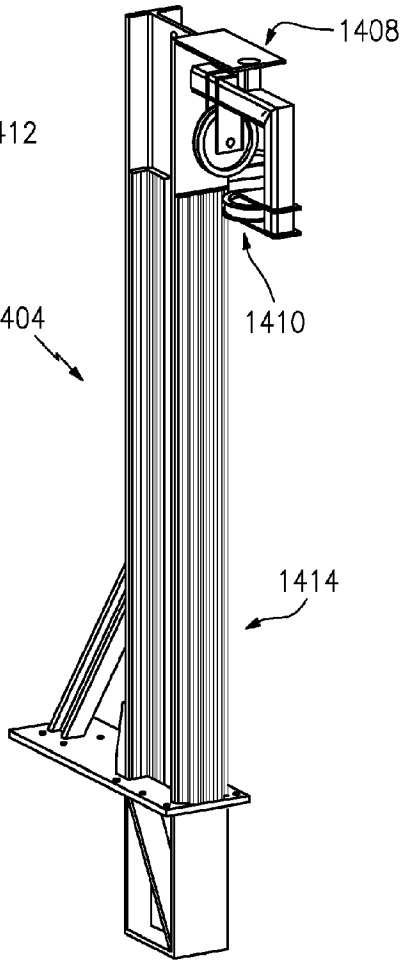
Figure 14A:
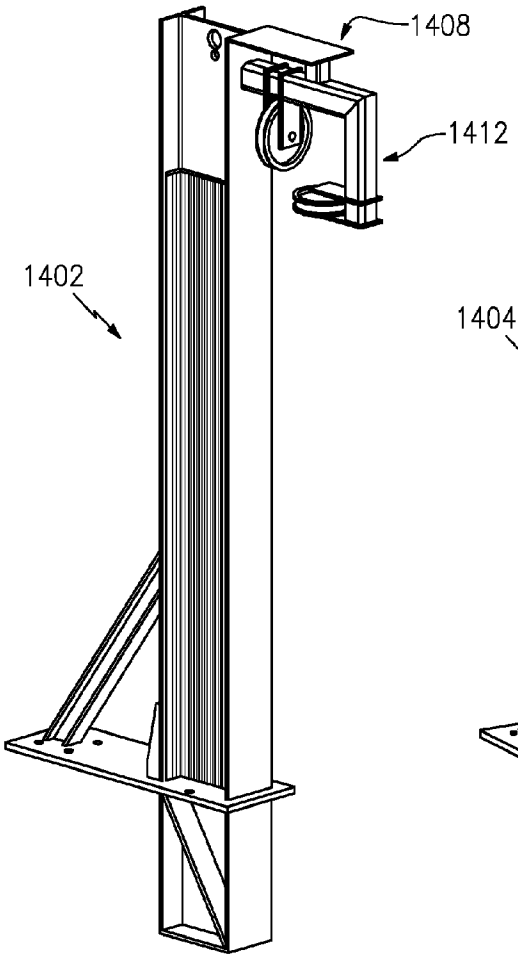

FIGS. 14(*a*)-(*c*) illustrate an embodiment of columns that are used for providing a gate to the floodwall system. When the floodwall system is used to protect a building, a garage, a park, or similar sites that have traffic in and out even before the storm, it is preferable to have a gate in the system that allows police, vehicles, or workers to enter and leave an enclosed site. According to an embodiment, a gate may be a wall panel having sliding wheels at the bottom. According to another embodiment, the gate is formed by a wall panel, gate column posts, and in-ground tracks. As shown in FIGS. 14(*a*)-(*c*), three column posts are used to provide a gate: a near end gate post 1402, a center gate post 1404, and a far end gate post 1408. Each gate post has a side wheel assembly 1409 that includes two wheels placed perpendicularly to each other and fixed on to a frame member 1412 so that one wheel is parallel to the column flange and the other wheel is perpendicular to the column flange. Both the center gate post 1404 and the far end gate post 1408 may further include a center wheel 1410 inside the grooves of the column posts. Both the center gate post 1404 and the far end gate post 1408 also have water seals 1414 and 1416 attached to the wet side of the columns. The water seal 1416 at the wet side of the far end column gate post 1406 may be an L-shaped member, which makes a water tight contact between the side of the wall panel and the L-shaped water seal.

The gate is preferably located at the wet side of the columns so as to allow the flood water to push the gate against the wet side water seals. When a gate is in an open position, the gate is placed between the near end gate post 1402 and the center gate post 1404. When the gate is in a closed position, the gate is placed between the center gate post 1404 and the far end gate post 1406.

Figure 15A:
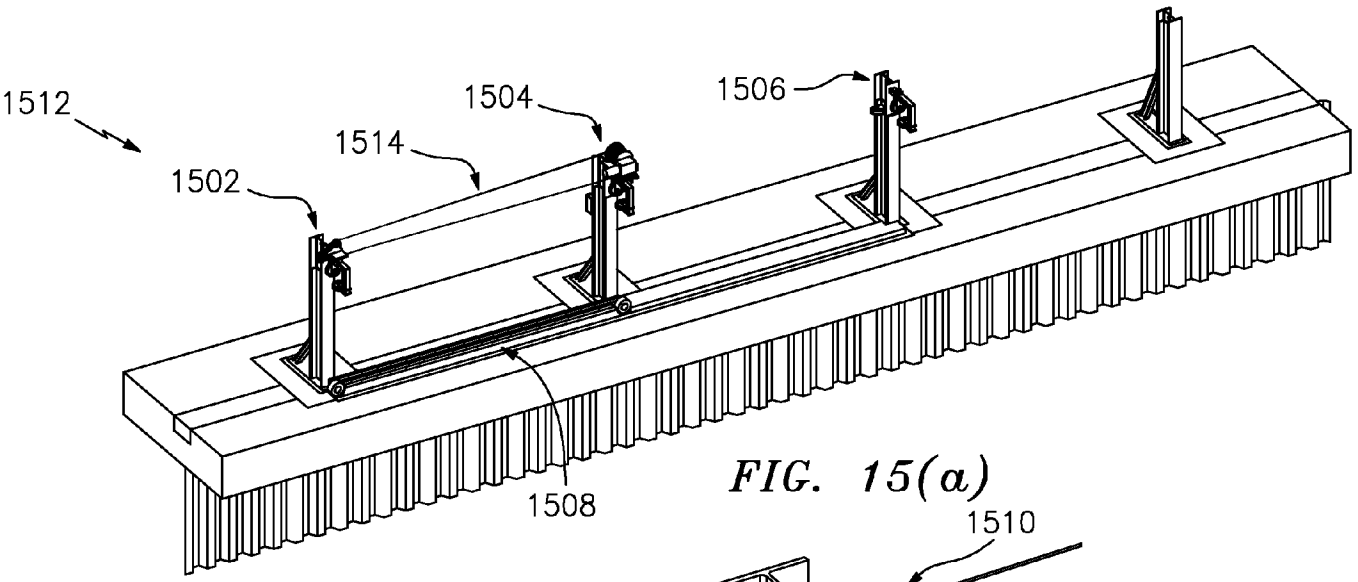
FIGS. 15(*a*)-(*c*) illustrate various embodiments of gates.
Figure 15B:
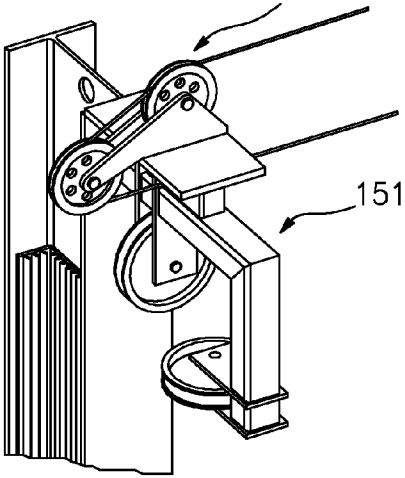
Figure 15C:
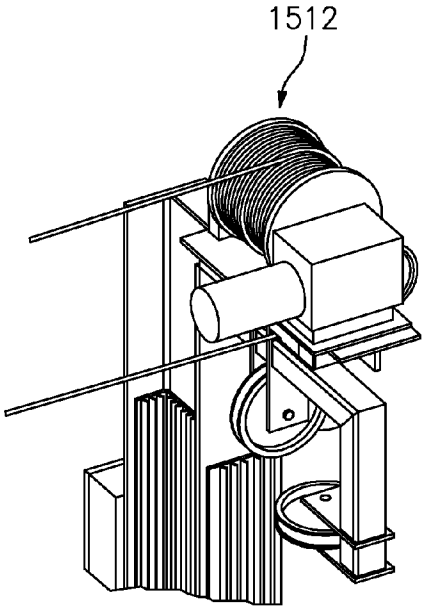
Figure 16A:
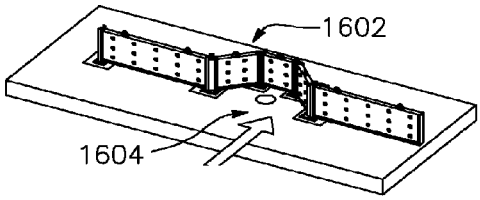
FIGS. 16(*a*)-(*h*) illustrate various embodiments of floodwall systems.
Figure 16B:
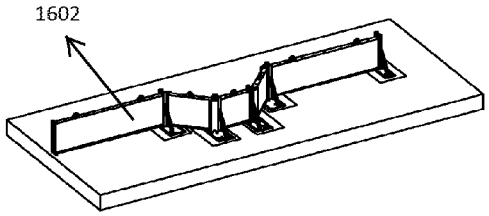
Figure 16C:
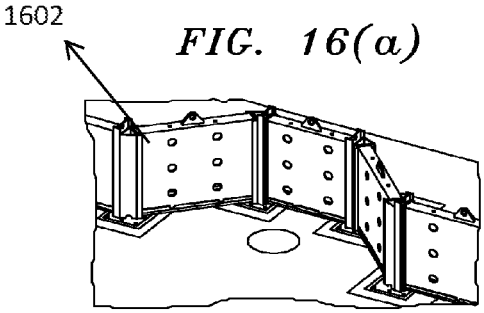
Figure 16D:
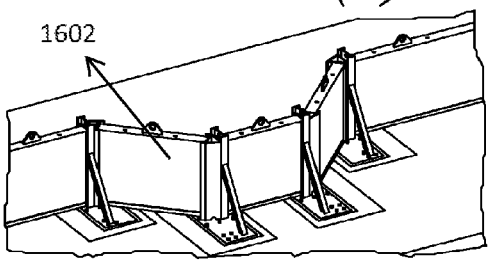
Figure 16E:
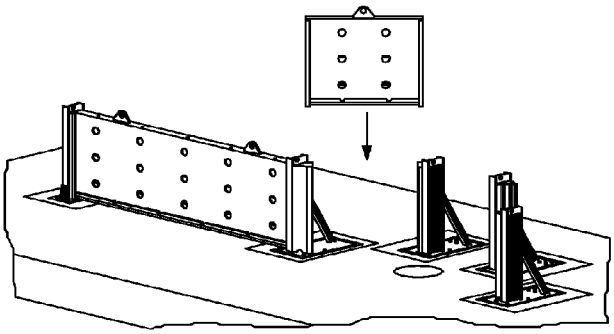
Figure 16F:
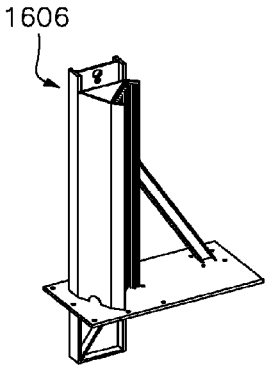
Figure 16G:
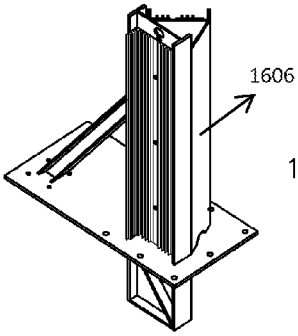
Figure 16H:
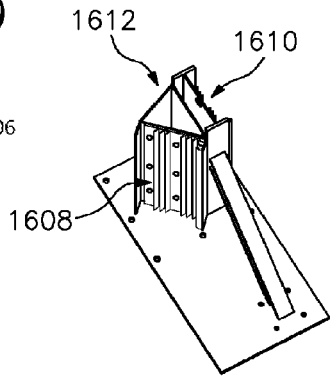

FIGS. 15(*a*)-(*c*) illustrate another embodiment of a gate. The gate 1512 includes a near end gate post 1502, a center gate post 1504, a far end gate post 1506, a track 1508, and a motor system 1514. The track 1508 has wheels so that a wall panel can easily slide on it. The motor system 1514 is installed on top of the near end gate post 1502 and the center gate post 1504 and includes a motor 1512 and a driving mechanism 1510. The driving mechanism 1510 may connect with the wheels of the side wheel assembly 1516 so that the motor 1512 can exert torque on theses wheels, which in turn move the wall panel along the track 1508 by the friction force between the wheels and the wall panel. According to an embodiment, the driving mechanism 1510 may be attached directly to the wall panel and exert a pulling force directly on the wall panel to move it along the slide track 1508.

Angled Floodwall

FIGS. 16(*a*)-(*h*) illustrate an embodiment of an angled floodwall system. When an existing structure 1604, either above, on, in, or under ground, is on the path of the floodwall system and cannot be removed or built on, an angled floodwall section 1602 can be installed to bypass the structure 1604. According to an embodiment, the angled floodwall section 1602 provides greater stiffness than a straight floodwall section because it has extended support along the flow direction. Thus, this angled floodwall section 1602 may be installed regularly along the floodwall system to increase the integrity of the overall floodwall system. The angled section 1602 uses similar wall panels and foundation systems as a straight section with the exception that the size of those structures needs to be modified.

Another difference between an angled floodwall section 1602 and a straight floodwall section is that the angled floodwall section 1602 uses angled columns. According to an embodiment, an angled column 1606 is formed by adding an angled section 1608 to a straight column 1610. The angled column 1606 further includes a brace 1612 that is attached to both the straight column 1610 and the angled portion 1612. According to an embodiment, the regular column 1610, the support portion 1612, and the angled portion 1608 forms a substantially triangular cross-section. The angled column 1606 allows an attached wall panel to form an angle with an adjacent wall panel, such as 30, 45, or 90 degrees.

Sloped Wall Panel

Figure 17A:
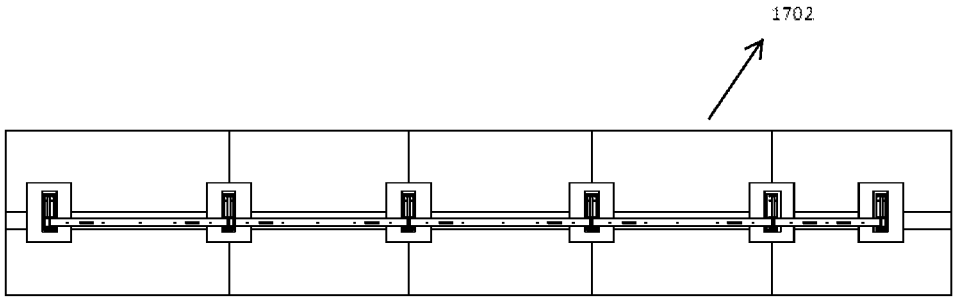
FIGS. 17(*a*)-(*c*) illustrate an embodiment of a sloped wall panel.
Figure 17B:
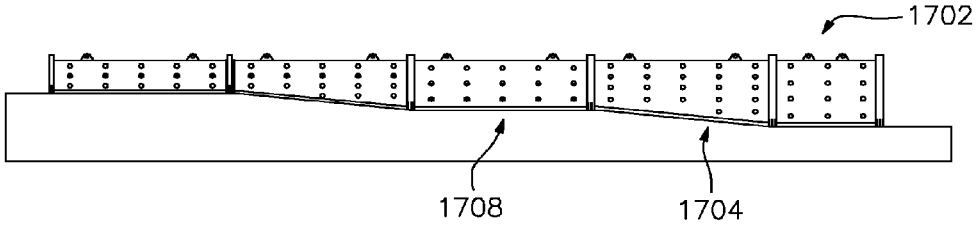
Figure 17C:
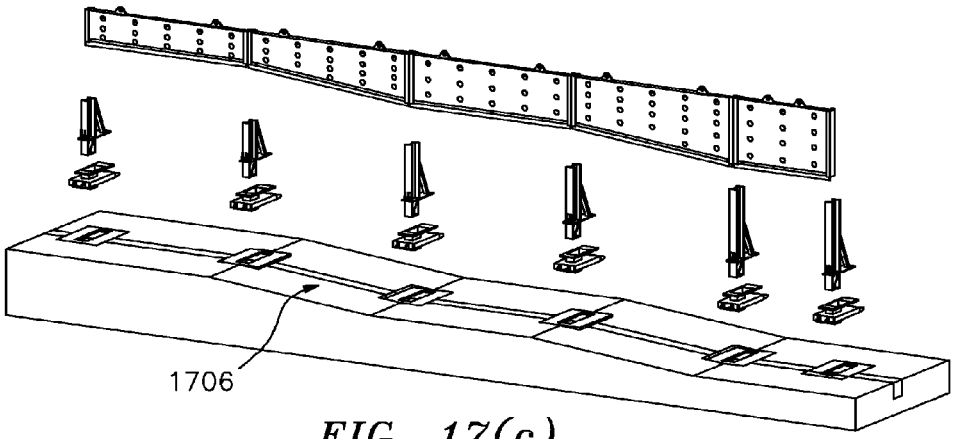
Figure 18A:
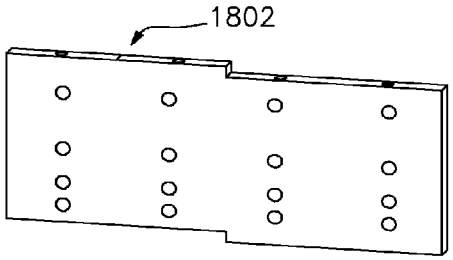
FIGS. 18(*a*)-(*e*) illustrate various embodiments of a wall panel that fits a curb.
Figure 18B:
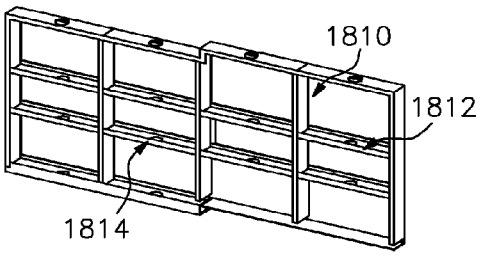
Figure 18C:
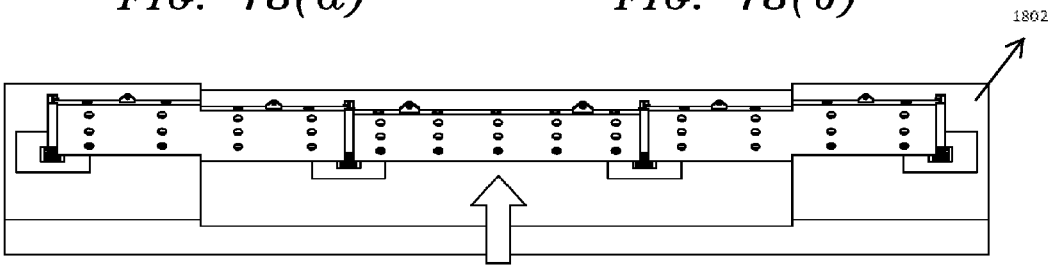
Figure 18D:
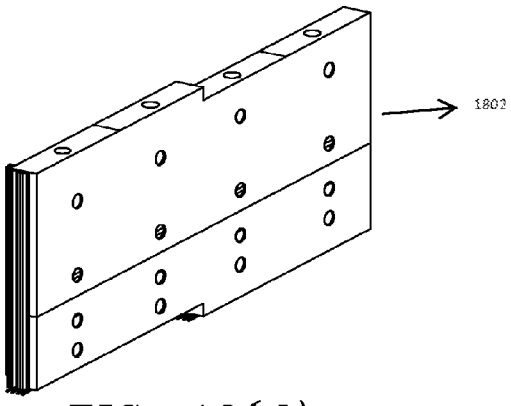
Figure 18E:
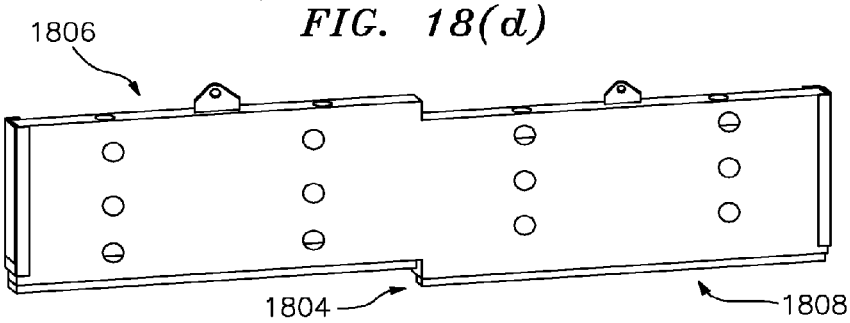

FIGS. 17(*a*)-(*c*) illustrate an embodiment of a sloped floodwall section. The sloped section 1702 can be used on a ground that is not well graded. The sloped section 1702 includes both a regular wall panel 1708 that has a flat bottom and a sloped wall panel 1704 that has a slanted bottom. The bottom of the sloped wall panel 1704 is designed to follow the sloped ground so that a tight water seal is formed. According to an embodiment, a concrete band 1706 may be built into the sloped ground to improve the contact between the ground and the sloped wall panel 1704.

Wall Panels for Curbs

FIGS. 18(*a*)-(*e*) illustrate an embodiment of a notched floodwall panel. The wall panel 1802 is made by two segments 1806 and 1808 that are offset from each other. The offset 1804 at the bottom of the wall panel 1802 is designed to match the height change of the ground due to a curb, which is a common structure in urban streets. According to an embodiment, a wall panel 1802 may have more than two segments that are offset to each other to match the height changes due to a plurality of curbs or other structures.

FIG. 18(*b*) illustrates the internal reinforcement members that are also used in other wall panels. The hollow chamber of the wall panel 1802 has both horizontal reinforcement members 1812 and vertical reinforcement members 1810 to prevent warping or buckling of the wall panel. The reinforcement members 1812 and 1810 also have perforations 1814 to allow water to fill all the compartments formed by those reinforcement members.

Wall Panel Anchored by Bollards

Figure 19A:
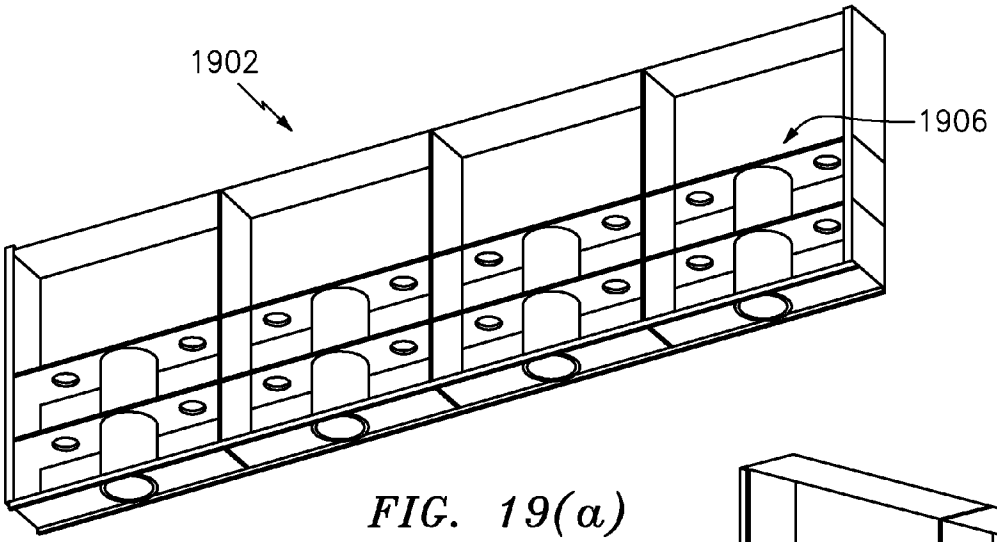
FIGS. 19(*a*) and (*b*) illustrate an embodiment of a wall panel that has sleeves.
Figure 19B:
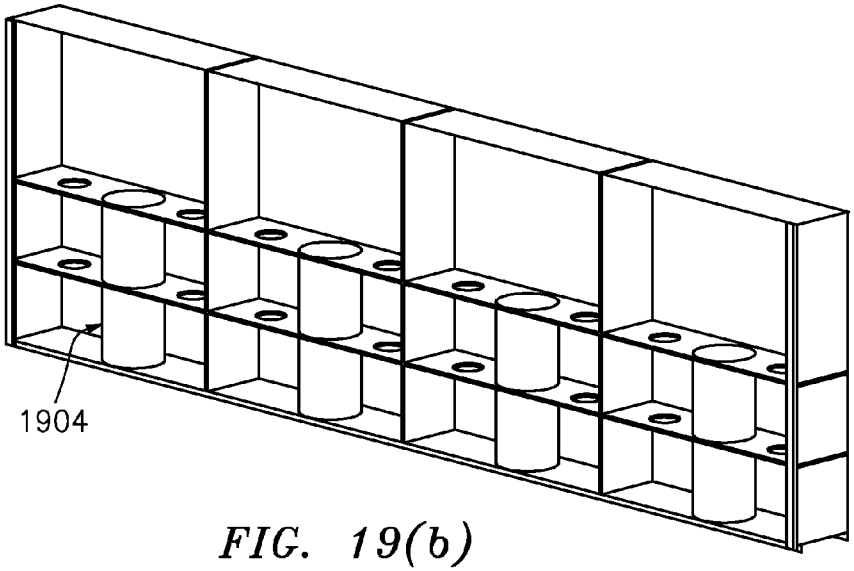
Figure 20B:
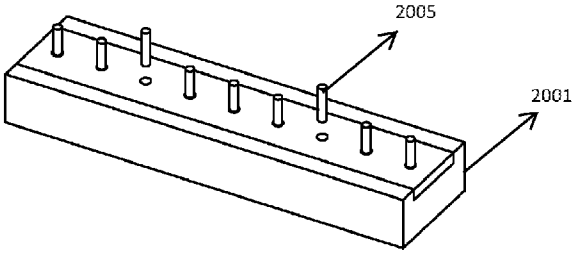
FIGS. 20(*a*)-(*d*) illustrate an embodiment of a wall panel mounted on removable bollards.
Figure 20A:
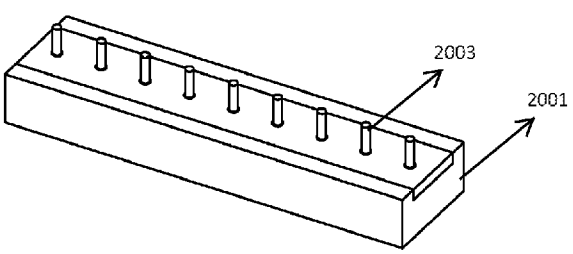
Figure 20C:
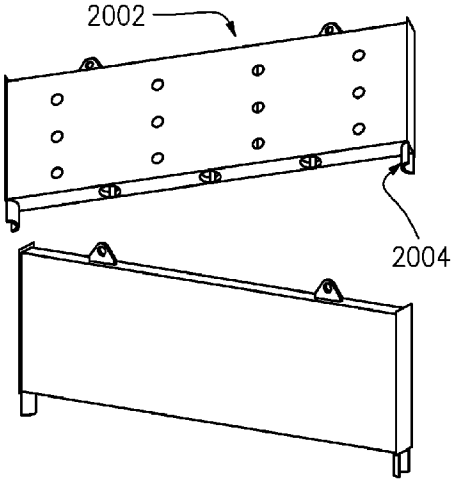
Figure 20D:
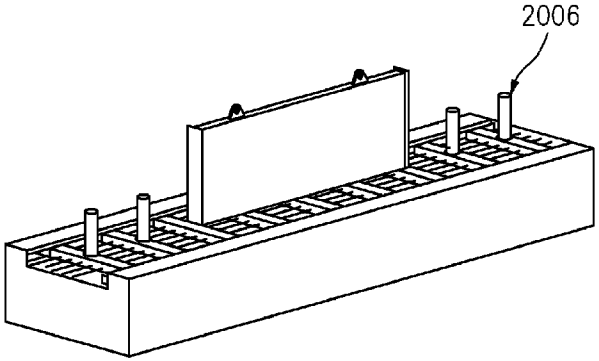

FIGS. 19(*a*) and 19(*b*) illustrate an embodiment of a wall panel that can be secured to existing bollards. The wall panel 1902 can use existing structures such as bollards as a foundation system so that the construction of a separate foundation is not required for the installation of the wall panel 1902. The wall panel 1902 includes a plurality of sleeves 1904 that are distributed among plural reinforcement members 1906 and located inside the wall panel 1902. The distance between the sleeves 1904 is set according to the distance of the existing bollards. Each sleeve 1904 covers one bollard, thus securing the wall panel 1902 to the bollards.

FIGS. 20(*a*)-(*d*) illustrate an embodiment of floodwalls over bollards. FIG. 20(*a*) illustrates fixed bollards 2003 that are permanently fixed to the ground 2001. FIG. 20(*b*) illustrates removable bollards 2005 that are removable from the ground 2001. FIG. 20(*c*) illustrates two sides of a wall panel that can be secured to removable bollards. The wall panel 2002 includes two end sleeves that extend outwardly from the wall panel 2002. The two end sleeves 2004 may be only a half sleeve or be a full sleeve. When the end bollards are removed from the ground, the end sleeves 2004 will fit into the corresponding excavation left by the removed bollards. FIG. 20(*d*) illustrates a floodwall panel placed over shallow-mount or surface-mount bollards 2006.

Boat Launch and Rope Ladder

Figure 21B:
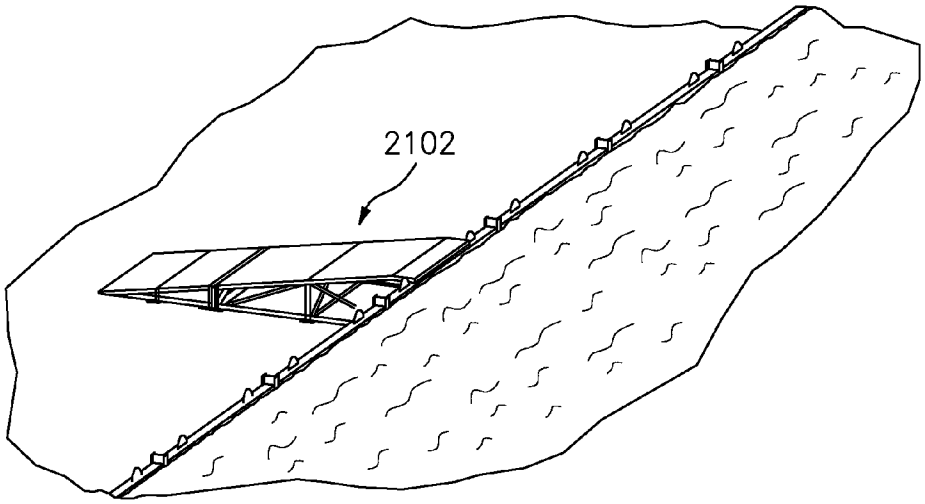
FIGS. 21(*a*) and (*b*) illustrate an embodiment of a boat launch.
Figure 21A:
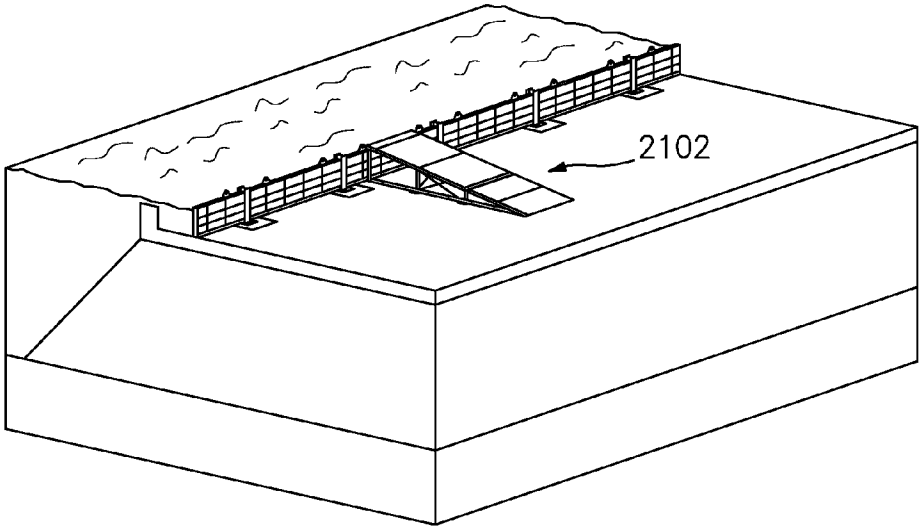

FIGS. 21(*a*) and 21(*b*) illustrate an embodiment of a boat launch of a floodwall system. The boat launch 2102 includes a plurality of sections that, when attached with each other, form a slope that runs from the ground to the top of the floodwall system. The boat launch 2102 can used to launch a boat to the flood water for patrol missions or rescue missions.

Figure 22A:
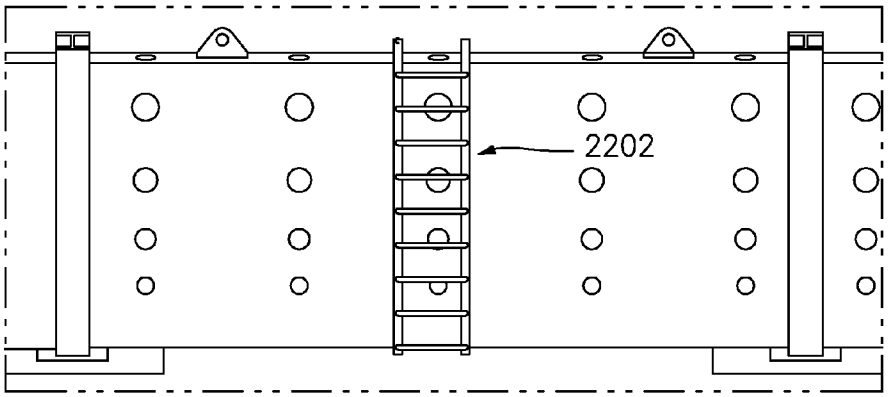
FIGS. 22(*a*) and (*b*) illustrate an embodiment of a rope ladder.
Figure 22B:
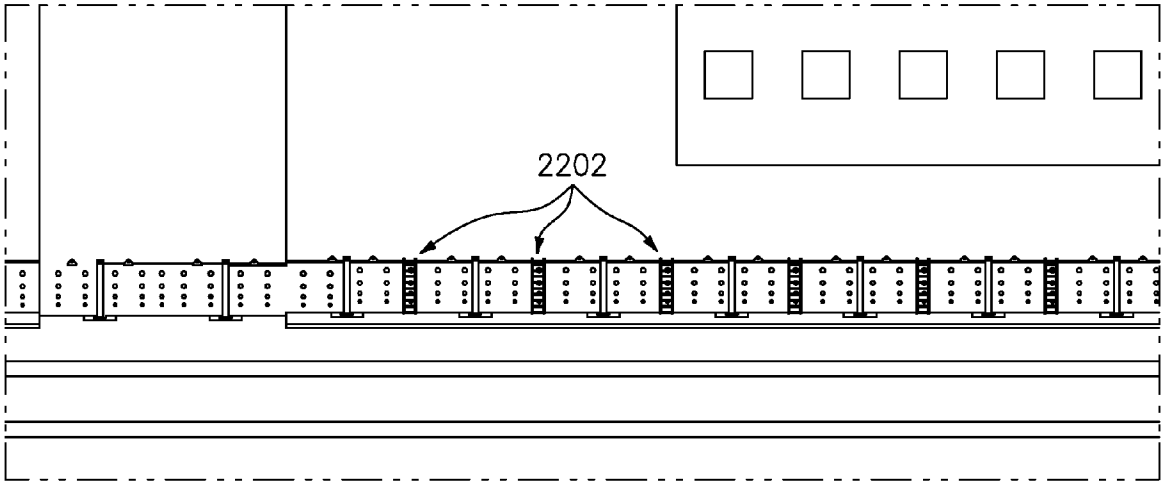
Figure 23:
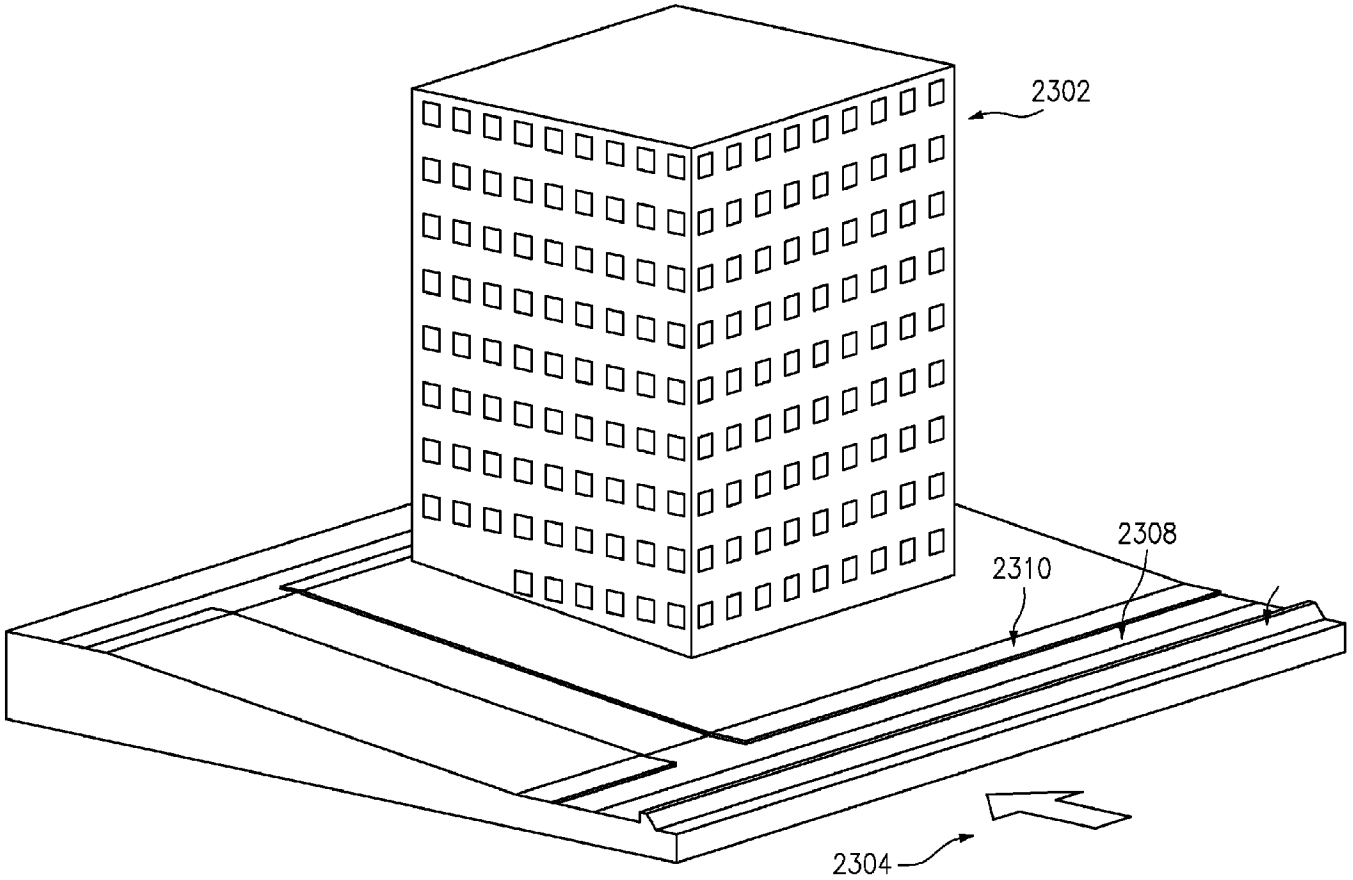
FIGS. 23-26 illustrate an embodiment of an installation method.

FIGS. 22(*a*) and 22(*b*) illustrate a rope ladder that can be used with each wall panel. The rope ladder 2202 allows people to climb over the floodwall.

Installation of the Floodwall System

FIGS. 23-26 illustrate an embodiment of an installation process of a floodwall system. The floodwall system will be deployed to protect a building 2302 that is located at a shore area close to seaway 2304. Adjacent to the building 2302 is the roadway 2308 and the sidewalk 2310. A floodwall system can be installed hours or one, two, or a few days before a coming storm to protect the building 2302 from any storm surge. When the magnitude of the storm is uncertain, the need for flood protection may be realized just a few hours before the storm arrives. The floodwall system may be installed without using the roadway because when the floodwall system is deployed, the roadway may still be left open to public.

Figure 24:
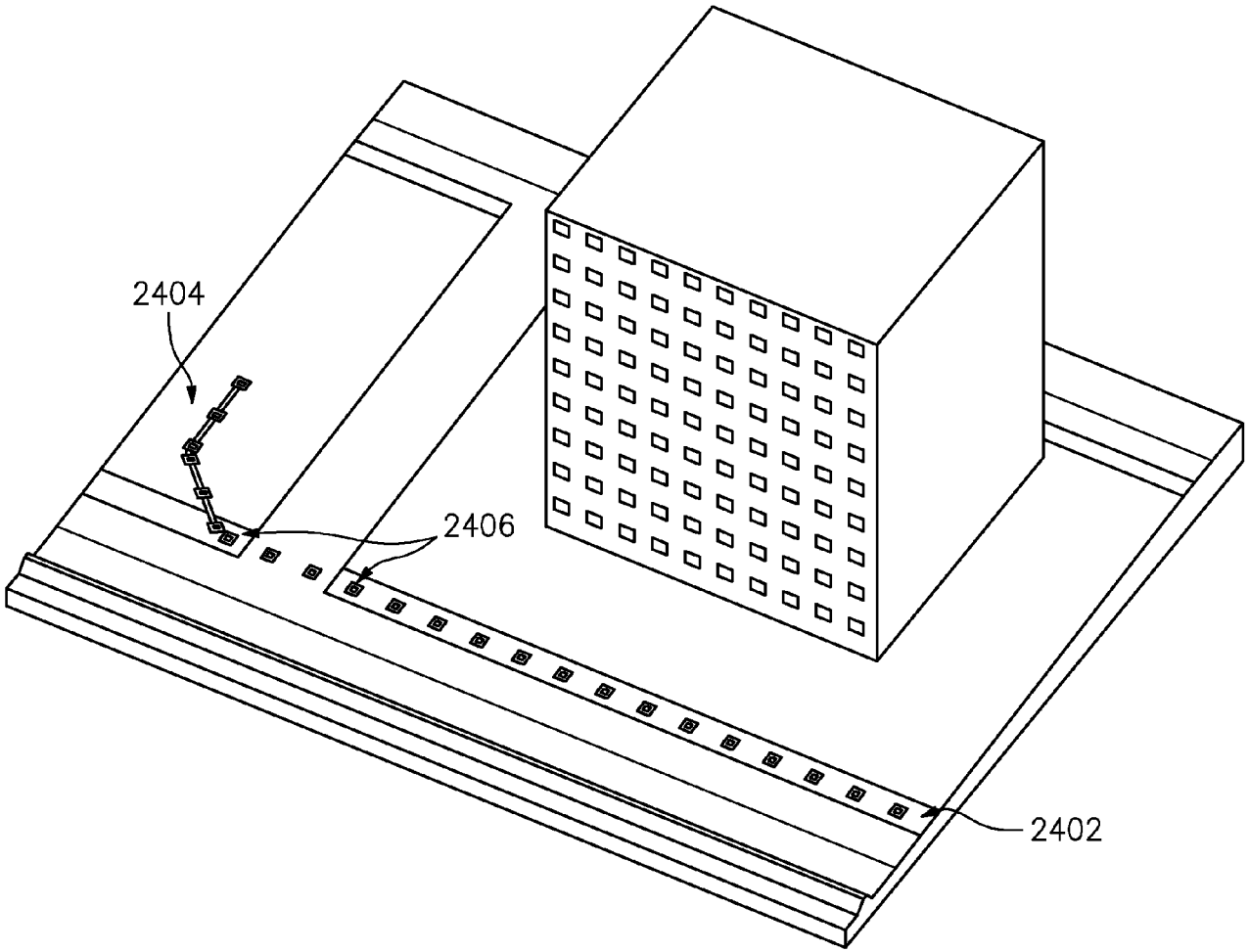
Figure 25:
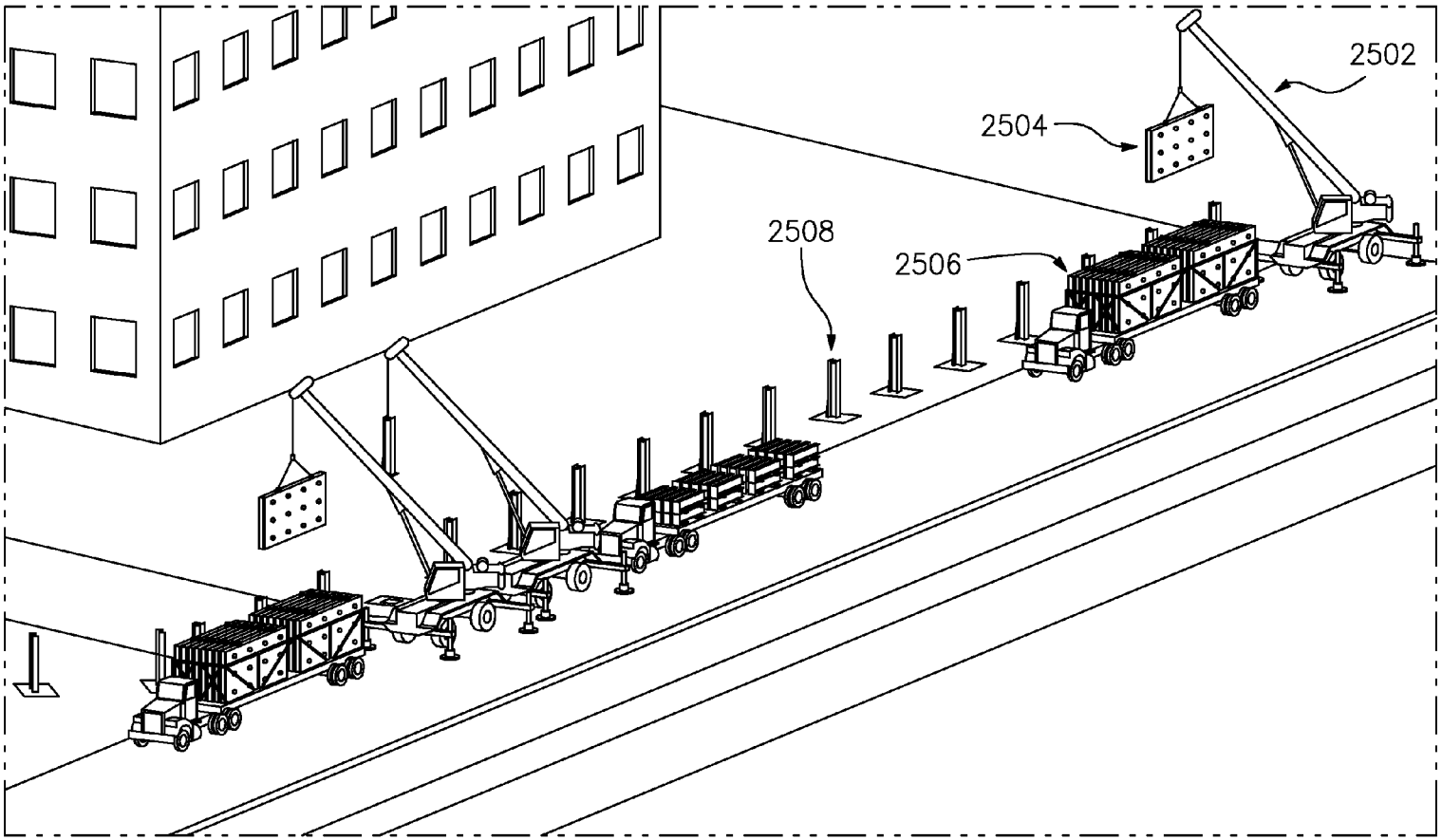

As shown in FIG. 24, the foundations 2406 of the floodwall system may be set up along the sidewalk 2402 and on the lawns 2404 of the building. The foundations 2406 may be independent foundation systems or connected foundation systems, either pre-installed or installed right before the flood event. After the foundation is set up, wall panels and columns are delivered by trucks 2506. These wall panels and columns are pre-manufactured and stored in standard containers so that they can be promptly delivered and installed. The deployment of the floodwall system requires only moderate equipment such as mobile cranes or backhoes 2502. Several crew members would be able to handle the installation. After the columns 2508 are installed on each foundation, the wall panels 2504 are picked up by mobile cranes from trucks and lowered into positions in between columns.

Figure 26:
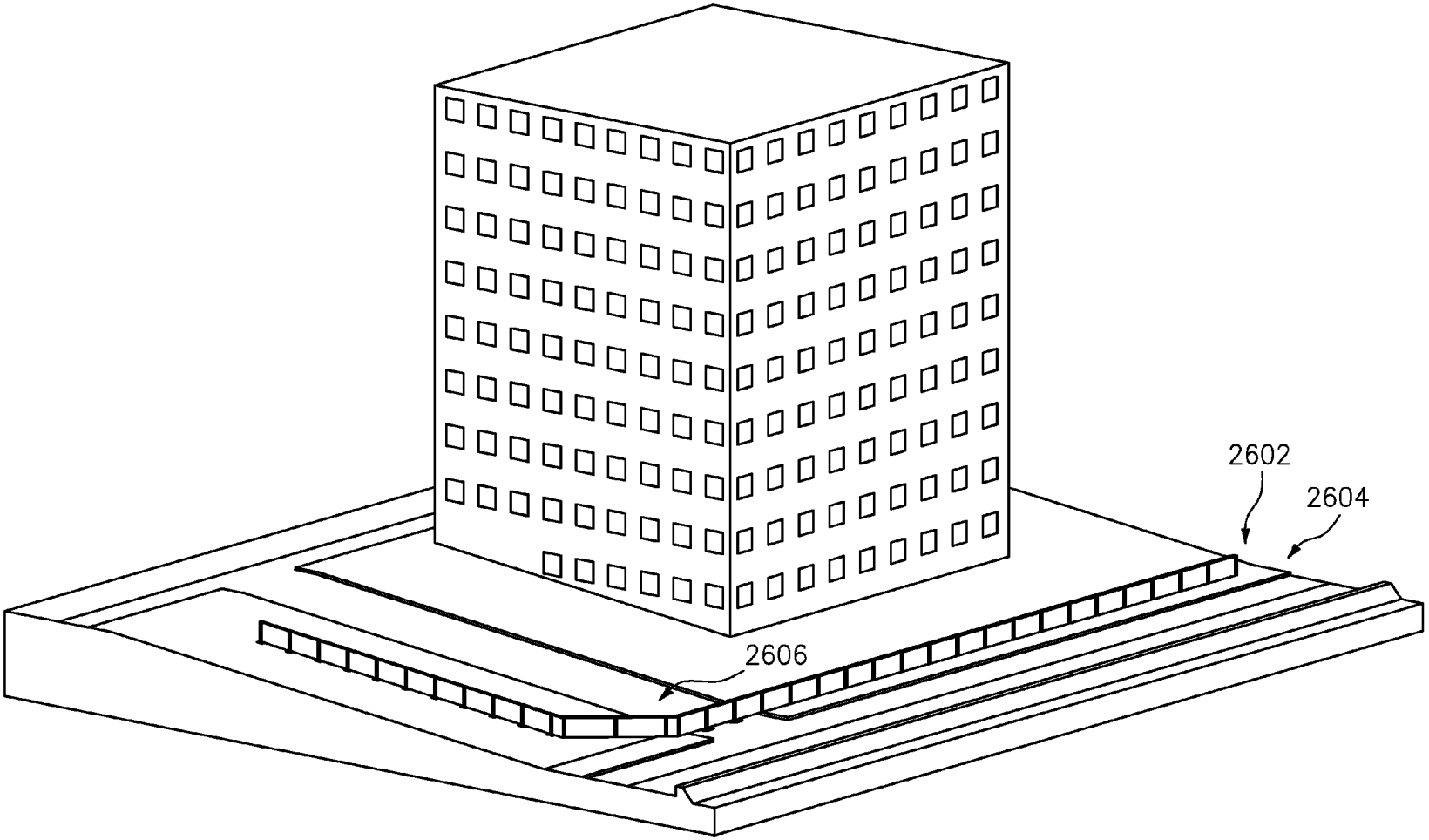

FIG. 26 illustrates a partially-deployed floodwall system. The floodwall system 2602 is installed along the sidewalk 2604 and crosses a private driveway 2606. The floodwall system 2602 eventually encircles the building and protects it from flood. Such a protection system can be deployed in days or even hours and is also removable.

Various Applications of the Floodwall System

Figure 27:
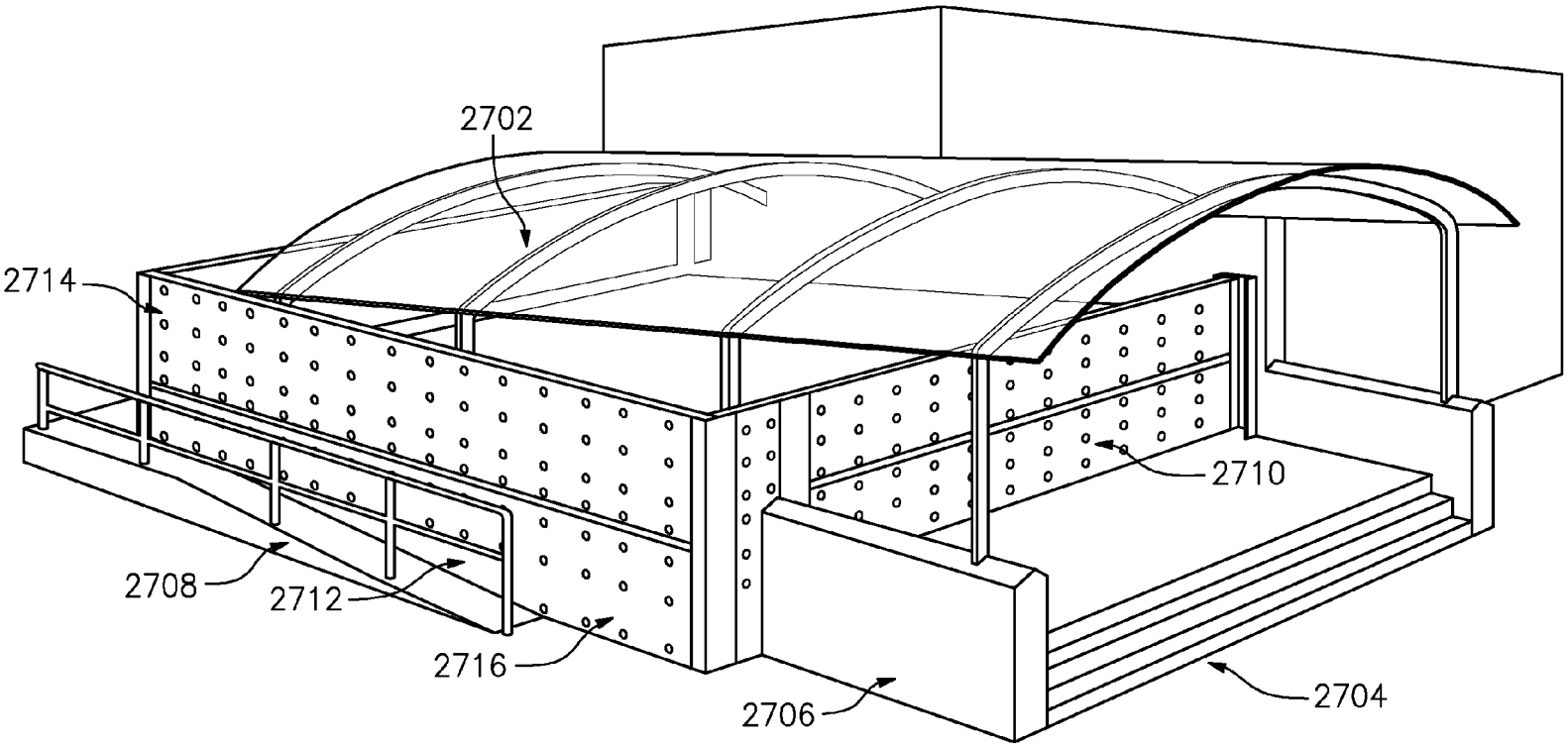
FIG. 27 illustrates an embodiment of a floodwall system protecting a subway entrance.

FIG. 27 illustrates an application of the floodwall system to protect a subway entrance. The subway entrance 2702 includes structures like stairs 2704, walls 2706, escalators (not shown), and handicap ramps 2708. The floodwall system 2710 includes an upper wall panel 2714 stacked over a lower wall panel 2716 so that the height of the walls is raised according to the magnitude of the storm. The wall panels are attached to adjacent buildings and secured to the ground. A sloped wall panel 2712 is used to fit tightly with the sloped handicap ramp 2708.

Figure 28:
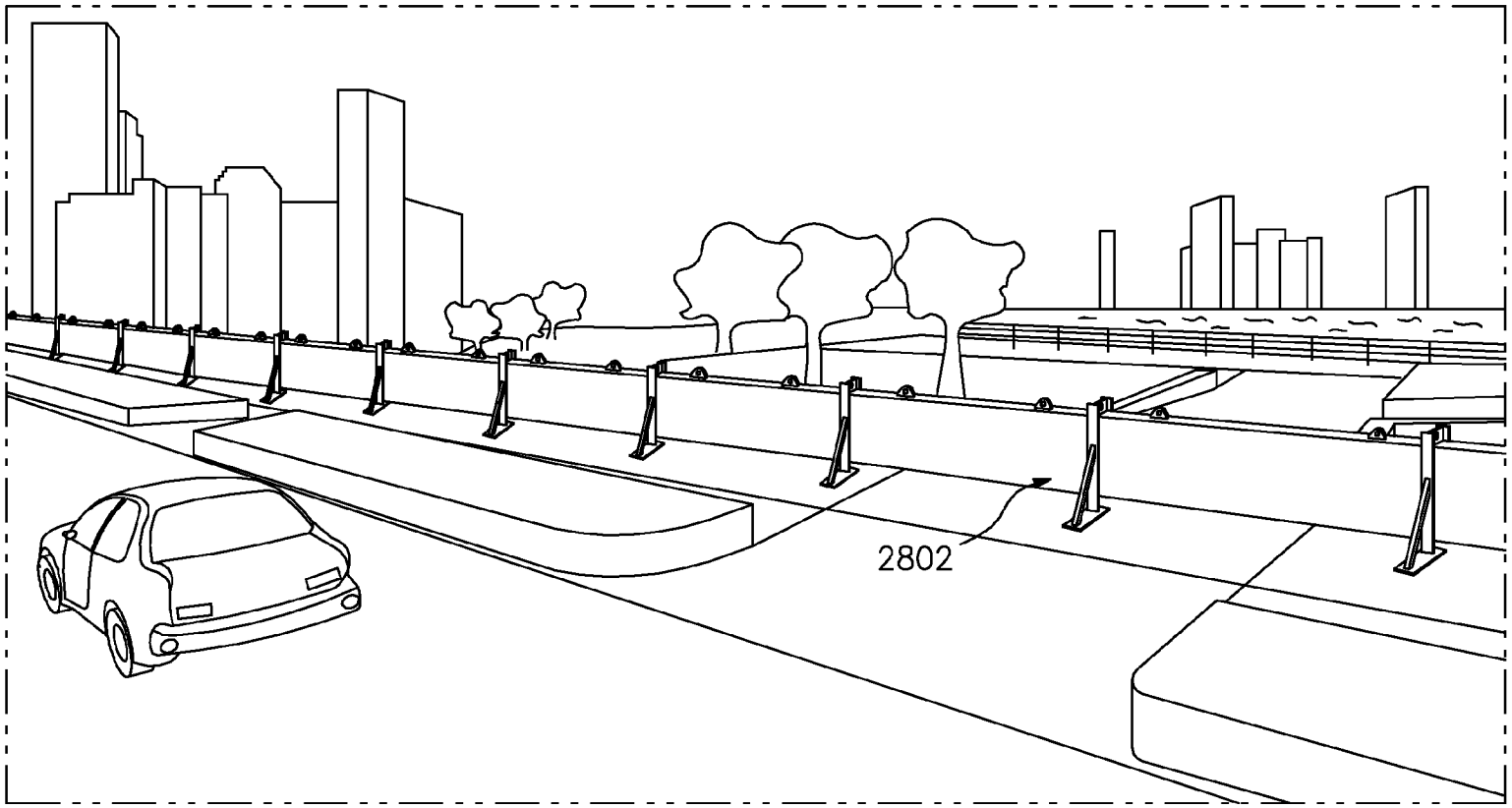
FIG. 28 illustrates an embodiment of a floodwall system deployed on a street.

FIG. 28 illustrates an embodiment of a protection system deployed on a street. The protection system 2802 has its columns secured directly to the street by using any proper securing means such as anchors, bolts, glue, concrete, or screws.

Figure 29A:
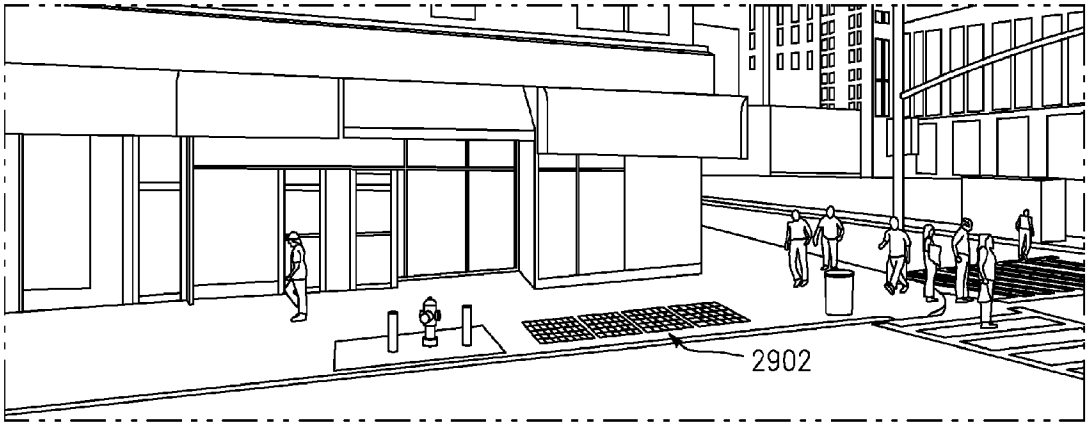
FIGS. 29(*a*)-(*c*) illustrate an embodiment of a floodwall system protecting subway vents FIGS. 30(*a*)-(*e*) illustrate various embodiments of a floodwall system protecting railroad tracks or railroad stations or railroad depot.
Figure 29C:
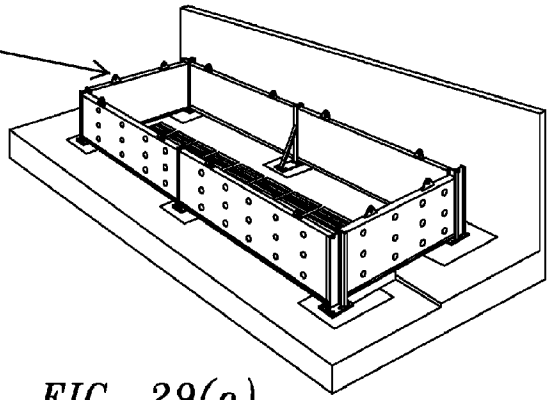
Figure 29B:
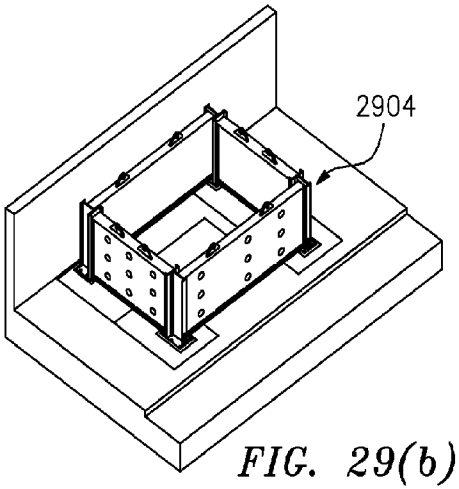
Figure 30B:
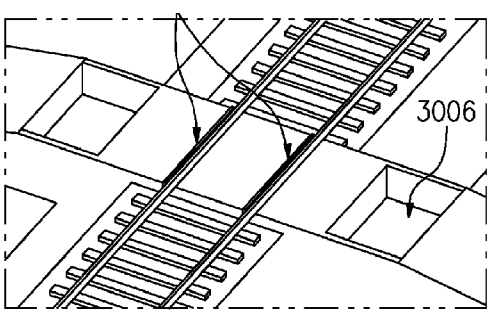
Figure 30A:
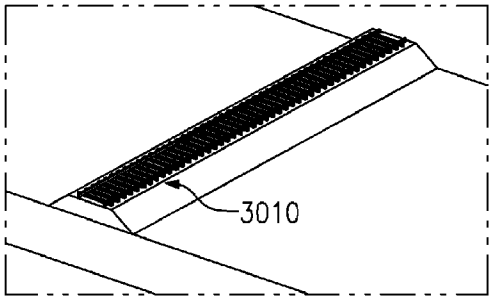
Figure 30C:
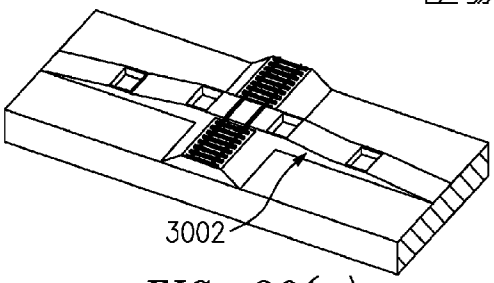
Figure 30E:
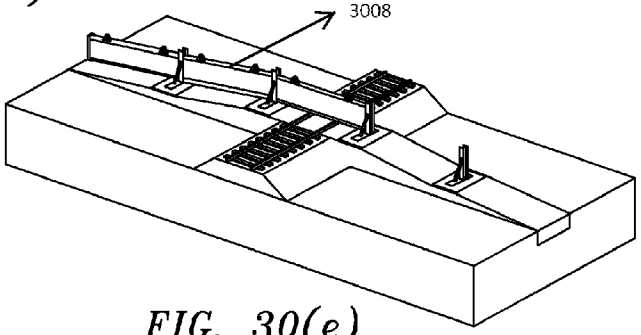
Figure 30D:
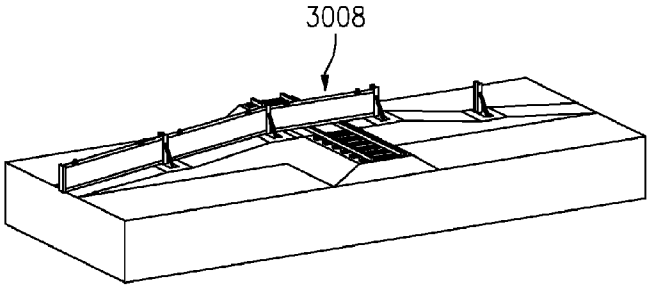

FIGS. 29(*a*)-(*c*) illustrate an embodiment of panels protecting subway vents. Subway vents 2902 are typically located on the sidewalk. The floodwall system 2904 has its own foundation built around the subway vent 2902 and forms a water tight structure that prevents water from leaking through the subway vent.

FIGS. 30(*a*)-(*e*) illustrate an embodiment of panels extending over railroad tracks or railroad depot. A foundation 3002 is first built around the railroad track 3010 to provide a transitional area between the railroad track 3010 and adjacent landscapes. Excavations 3006 are prepared in the foundation so that the foundation system of the system can be fit into and anchored to the ground. Any gap formed between the railroad track and the foundation is filled with elastic materials such as rubber or elastomers to provide a water seal. Then, the columns and the wall panels 3008 are installed across the track to provide protections to the stations or depot at the end of the tracks.

Wall Attachment of the Floodwall System

Figure 31:
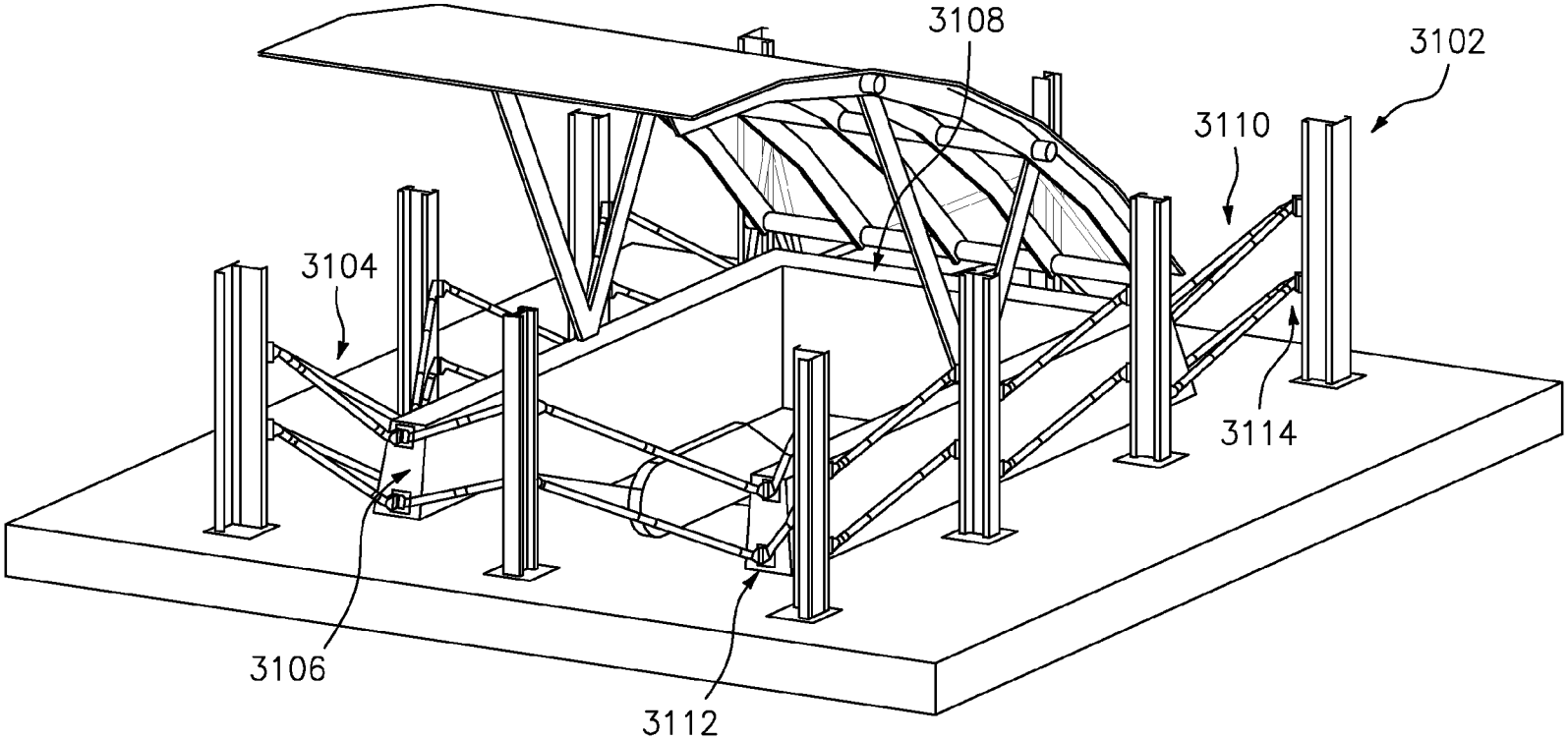
FIG. 31 illustrates an embodiment of a wall attachment unit of a floodwall system.

FIGS. 31-36 illustrate an embodiment of a wall attachment structure for a floodwall system. As shown in FIG. 31, the columns 3102 of the system are not only secured to the foundation system but also attached to other structures such as walls 3106 of a subway entrance 3108. The attachment structure 3104 includes a wall mount 3112, a linkage 3110, and a column mount 3114. The wall mount 3112 is attached to the walls 3106. The column mount 3114 is attached to the columns 3102. The linkage 3110 connects the wall mount 3112 and the column mount 3114.

Figure 32:
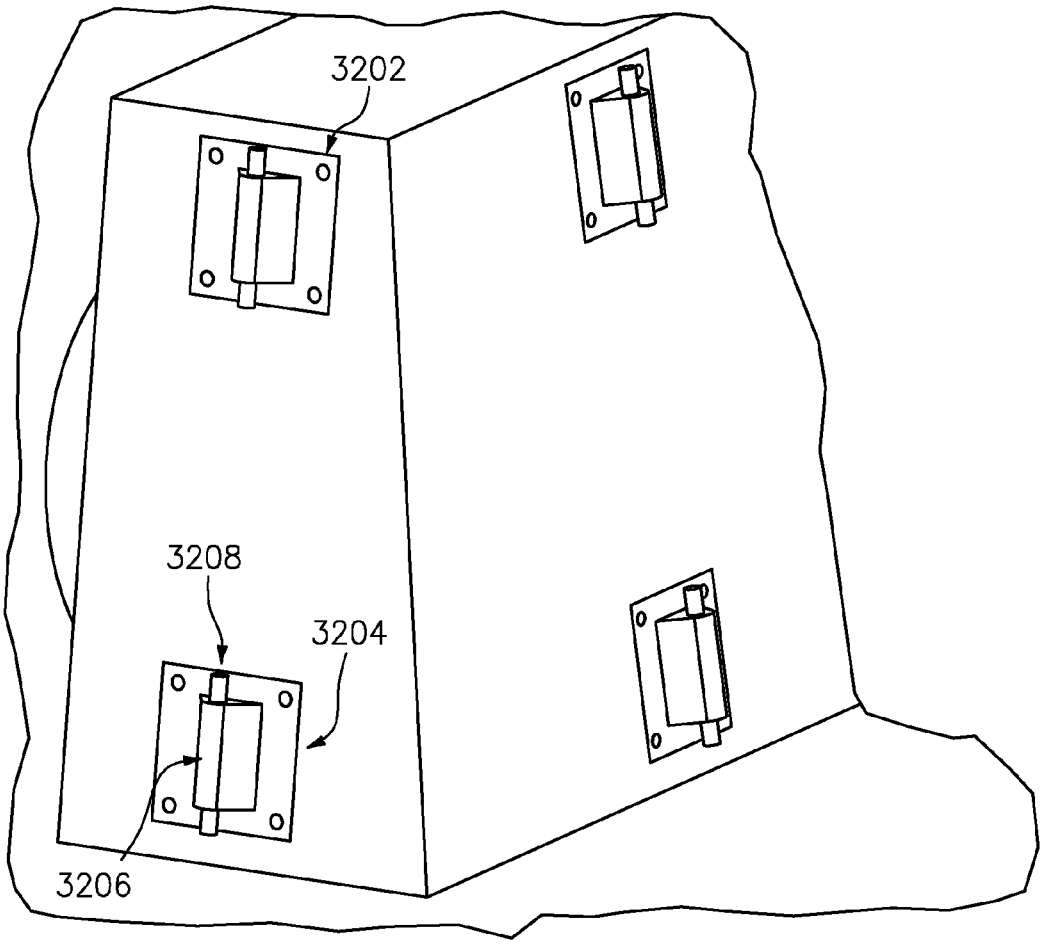
FIG. 32 illustrates an embodiment of a wall mount.

Referring to FIG. 32, the wall mount 3202 includes a plate member 3204 secured to the wall and an attachment member 3206 that uses a pin member 3208 to attach a linkage. The plate member may be permanently secured to the wall or may be detachably removable from the wall.

Figure 33C:
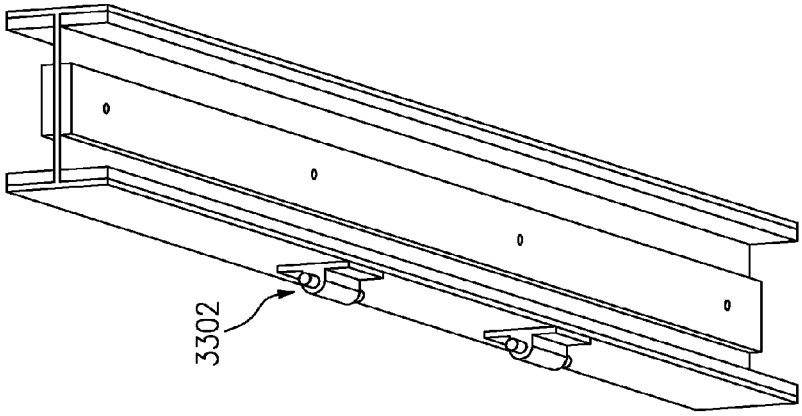
FIGS. 33(*a*)-(*c*) illustrate various embodiments of a column mount.
Figure 33B:
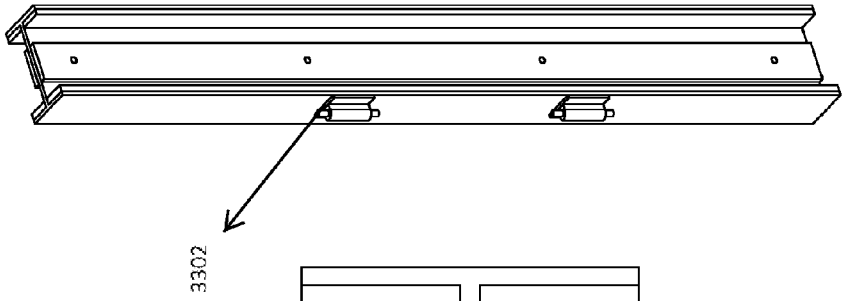
Figure 33A:
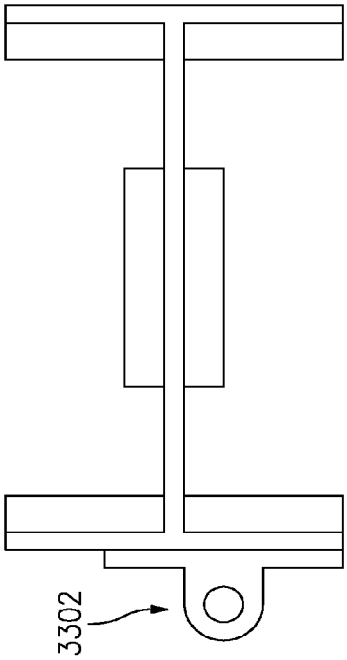

FIGS. 33(*a*)-(*c*) illustrate an embodiment of a column mount 3302. The column mount 3302 has a similar structure as that of the wall mount.

Figure 34:
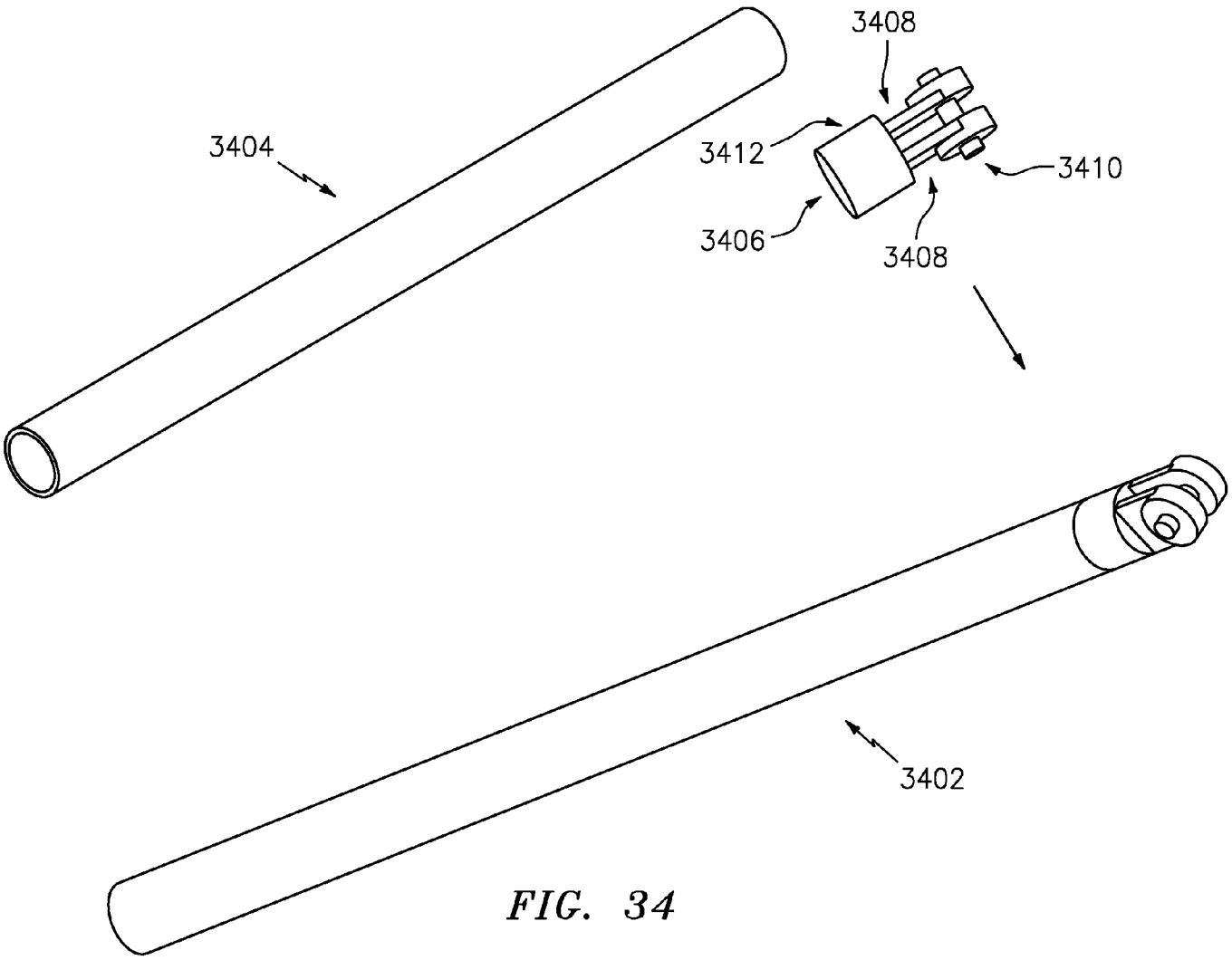
FIG. 34 illustrates various embodiments of a linkage.

FIG. 34 illustrates an embodiment of a linkage for the floodwall system. The linkage 3402 includes a tubular member 3404 and a clevis member 3406 which is connected with the tubular member 3404. The tubular member 3404 may be any structural member that can resist push or pull forces caused by the flood water. For example, the tubular member 3404 may be a stainless steel pipe. The clevis member 3406 includes an attachment part 3412, two prongs 3408, and a clevis pin 3410. The attachment part 3412 is used to attach the clevis member 3406 with the tubular member 3402.

Figure 35C:
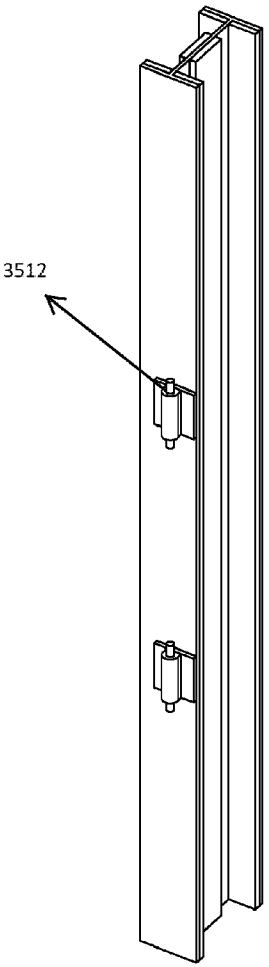
FIGS. 35(*a*)-(*c*) illustrate various embodiments of the connection between the wall mount and the linkage.
Figure 35B:
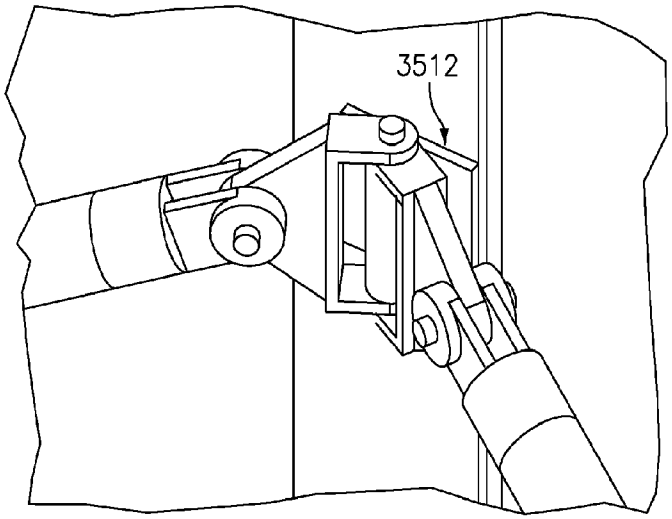
Figure 35A:
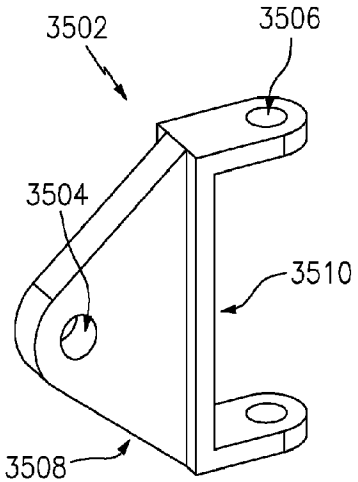
Figure 36:
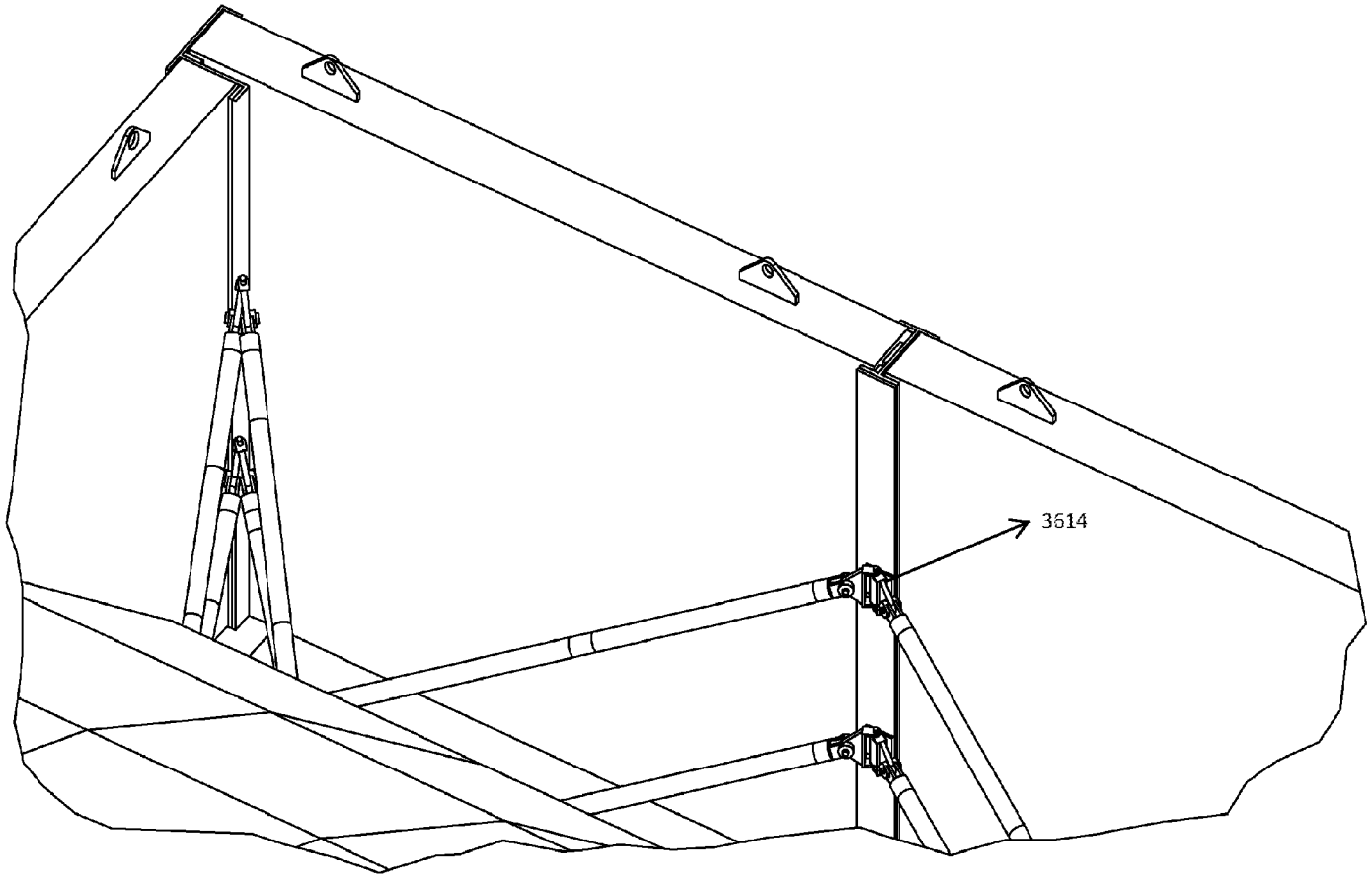
FIG. 36 illustrates an embodiment of the connection between the column mount and the linkage.

FIG. 35(*a*) illustrates an embodiment of a swing eye used to connect the linkage with the wall mount or the column mount. The swing eye 3502 includes a clevis attachment part 3508 which has a clevis pin hole 3504 and a wall mount attachment part 3510 which has wall mount pin holes 3506. The clevis attachment part 3508 and the wall mount attachment part 3510 are attached to each other or may be formed by one piece of material. The clevis pin hole 3504 accepts the clevis pin, while the wall mount pin holes 3506 accept the pin of the wall mount. As shown in FIG. 35(*b*), the wall mount 3512 can accept two adjacent linkages which form an angle with the wall. Upon attachment, the clevis pin and the wall mount pin are substantially perpendicular to each other. Similar mechanism is used for the attachment of the linkage to the column mount 3614, as shown in FIG. 36.

Figure 37:
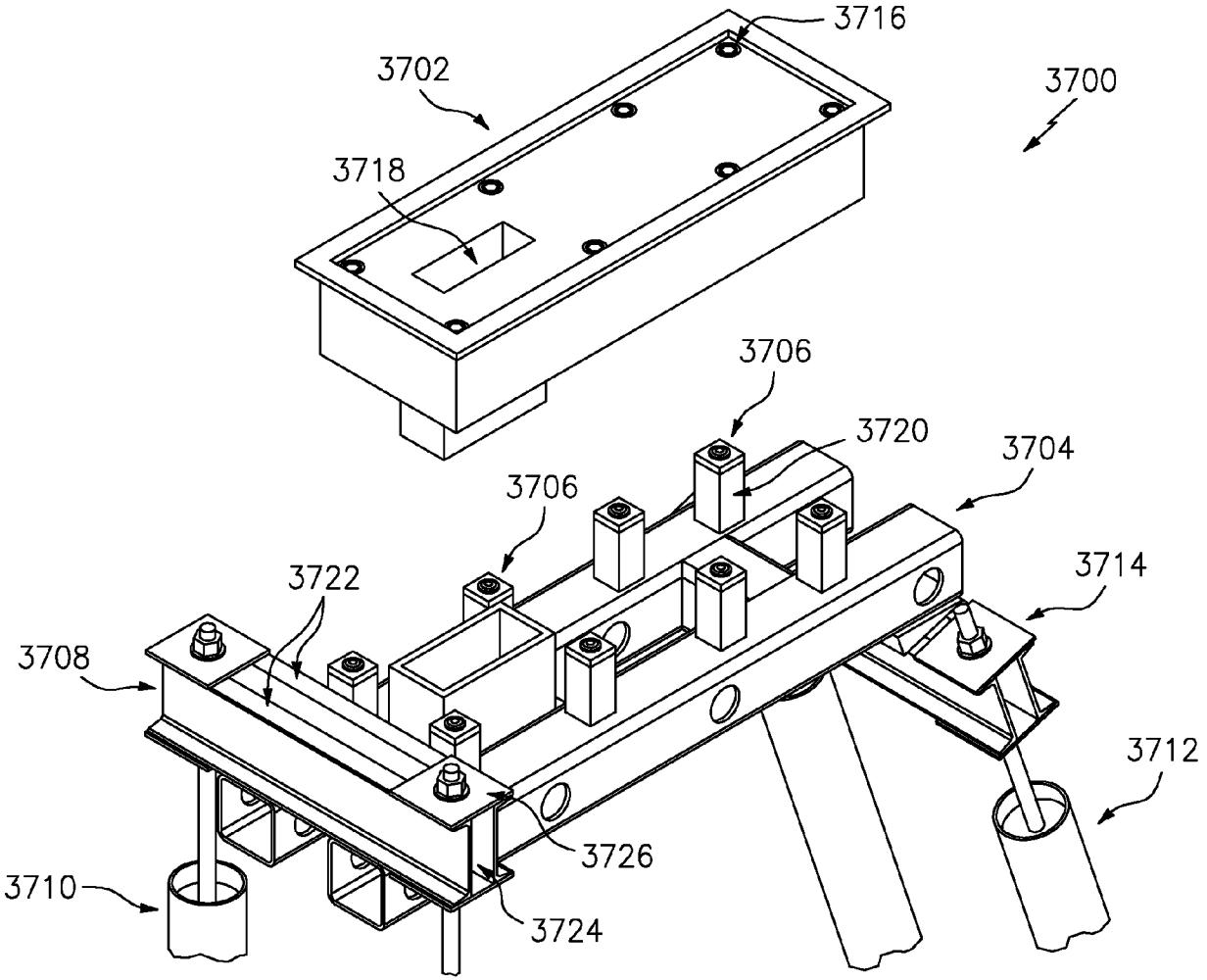
FIG. 37 illustrates an embodiment of a foundation.
Figure 38:
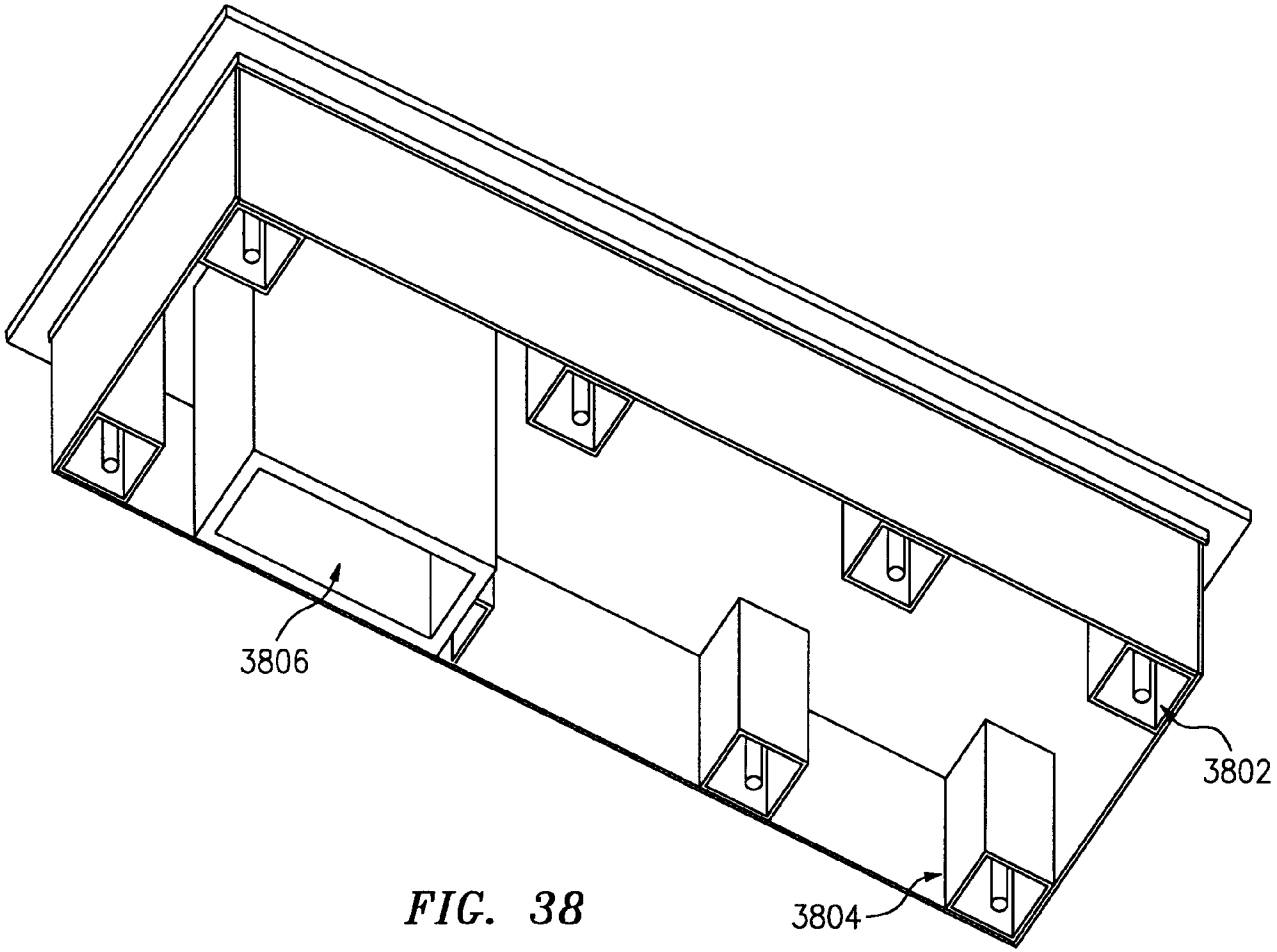
FIG. 38 illustrates an embodiment of a foundation.

FIGS. 37 and 38 illustrate an embodiment of a foundation of a floodwall system. As a common practice in roadway maintenance, the surface or the blacktop of a roadway is removed and then repaved multiples times. The removal and re-pavement of the roadway may alter the elevation of the roadway from its original point. If the foundation system of a floodwall system is fixed in a roadway and experiences a few removals and re-pavement of the roadway surface, the contact area between the floodwall system and the roadway may not be as tight as before. FIG. 37 shows an embodiment of the construction of a height-adjustable foundation of a floodwall system. The adjustable foundation 3700 has an upper portion 3702 and a lower portion 3704. The upper portion 3702 has a plurality of sleeves 3804 that fit the plurality of posts 3720 of the lower portion 3704. Each post 3720 has a screw jack system 3706 that can raise the elevation of the post 3720. Each sleeve 3804 has screw driving means 3802 in FIGS. 38 and 3716 in FIG. 37 in the center that is used to drive the screw jack system. The screw driving means is used by a worker to turn the screw jack system 3706 to adjust the height of the foundation 3700. The upper portion 3702 has a socket 3718 for securing columns.

According to an embodiment, the lower portion 3704 has movable attachment parts 3708 and 3714 that are used to attach the anchors 3710 or piles 3712. When the anchors 3710 and piles 3712 are set up in the ground, their positions may deviate from original designs, thus making it difficult to use pre-set holes on the foundation to attach them. The movable attachment parts 3708 and 3714 have greater tolerance of misalignments of the anchors or poles. The movable attachment parts ease the job to fit piles or anchors with the attachment parts and to fix the attachment parts on the foundation. The movable attachment parts 3708 and 3710 are formed by joining two U-shaped beams 3722 at both the top and the bottom with flat plates 3726. A channel 3724 between the two U-shaped beams allows the anchors 3710 to pass through and to be secured on the top plate. The moveable attachment part 3708 is not permanently fixed onto the foundation 3700. It may be moved along the longitudinal direction of the foundation 3700 and may cover a wide range of angles with the longitudinal axis, such as from 60 degrees to 120 degrees.

According to an embodiment, the height-adjustable foundation 3700 is encased in concrete to provide a base for the removable columns/posts and/or wall panels. The foundation is positioned flush with the surrounding surface. The lower part of the adjustable foundation is attached to sub surface structures such as micro piles or sheet piles. The upper section is free to move up and down a total of several inches, such as 6 inches, to match the new surface elevation. The upper section is guided by 8 square posts and sleeve elements. In the center of each post and sleeve element is placed a large screw jack system. Turning a nut on the surface turns the internal screw and raises or lowers the top section. When the floodwall system is not used, a flat cover plate with flush bolts is attached to the top section. Prior to a flood event, the cover plate is removed and the prepared columns/posts are inserted into the socket and bolted in place. When either the cover or the column/post is bolted in place, the adjustable feature is locked to prevent movement Although the above-description has used flood water as an example, the application of the present application is not limited to protect structures from flood water. The present application may be used for protection against all forms of fluidic or semi-fluidic intrusion or spill, including flood water, crude oil, paint, mud, sand, and similar subjects. Embodiments of floodwall systems of the present applications are not limited to removable system, and they can also be used permanent protection systems.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention as defined by the appended claims.

What is claimed is:

1. A floodwall system comprising:

a foundation system having a base permanently anchored to the ground;

a plurality of wall panels detachably attached to a plurality of columns; and a securing mechanism for detachably and directly anchoring the plurality of columns to the base;

wherein each of the plurality of wall panels includes a chamber having a plurality of compartments, a dry-side wall and a wet-side wall on opposing sides of the panel, and perforations in the wet-side wall to receive water and increase the mass of the wall panels, and wherein each of the plurality of wall panels includes a top plate having a plurality of vent perforations, and wherein the perforations of the wet-side wall allow flood water to enter the chamber.

2. The floodwall system of claim 1, wherein a height of the foundation system is adjustable.

3. The floodwall system of claim 1, wherein the foundation system is secured to the ground by at least a rock anchor.

4. The floodwall system of claim 1, wherein the foundation system includes a shallow-mount bollard system.

5. The floodwall system of claim 1, wherein the foundation system includes a plate member.

6. The floodwall system of claim 1, wherein the foundation system includes a shoe member fixed on a rebar cage.

7. The floodwall system of claim 1, wherein the foundation system includes a decorative cover member to disguise the foundation system from surrounding landscapes.

8. The floodwall system of claim 1, wherein sizes of the perforations of the wet-side wall of each of the plurality of wall panels are gradually enlarged from a bottom of each of the plurality of wall panels to a top of each of the plurality of wall panels.

9. The floodwall system of claim 8, wherein each of the plurality of wall panels includes water seals at two ends.

10. The floodwall system of claim 9, wherein each of the plurality of wall panels includes a plurality of handles used for lifting purposes during deployment.

11. The floodwall system of claim 10, wherein at least one of the plurality of wall panels includes a sleeve member that fits a bollard.

12. The floodwall system of claim 10, wherein at least one of the plurality of wall panels includes a sloped bottom.

13. The floodwall system of claim 10, wherein at least one of the plurality of wall panels includes two offset portions.

14. The floodwall system of claim 1, wherein each of the plurality of columns includes a brace attached to both an upper leg of each of the plurality of columns and a ground support member of each of the plurality of columns, wherein the ground member, upon installation, is substantially at a ground level.

15. The floodwall system of claim 1, wherein each of the plurality of columns includes a panel lock.

16. The floodwall system of claim 1, wherein the columns include at least one angled column that allows adjacent wall panels to form an angle with each other.

17. The floodwall system of claim 1, wherein the wall panels are lowered into positions in between the plurality of columns.

18. The floodwall system of claim 1, further comprising a gate.

19. The floodwall system of claim 1, further comprising attachment members that attach the plurality of columns to adjacent existing structures.

20. The floodwall system of claim 1, further comprising a boat launch.

* * * * *